US008393105B1

(12) United States Patent
Thummel

(10) Patent No.: US 8,393,105 B1
(45) Date of Patent: Mar. 12, 2013

(54) FLOATING SIDE RAIL CLAMP WEAPON ACCESSORY MOUNT ADAPTOR

(75) Inventor: Heinz Thummel, Salinas, CA (US)

(73) Assignee: Laser Devices, Inc., Monterey, CA (US)

( * ) Notice: Subject to any disclaimer, the term of this patent is extended or adjusted under 35 U.S.C. 154(b) by 420 days.

(21) Appl. No.: 12/769,808

(22) Filed: Apr. 29, 2010

(51) Int. Cl.
*F41C 27/00* (2006.01)
*F41G 1/387* (2006.01)

(52) U.S. Cl. ..... 42/90; 42/127

(58) Field of Classification Search ..... 42/90, 124, 42/125, 126, 127; 403/373, 374.5; 248/231.41
See application file for complete search history.

(56) References Cited

U.S. PATENT DOCUMENTS

| | | | | |
|---|---|---|---|---|
| 5,375,362 | A | 12/1994 | McGarry et al. | |
| 5,531,040 | A | 7/1996 | Moore | |
| 5,822,905 | A | 10/1998 | Teetzel | |
| 6,442,883 | B1 * | 9/2002 | Waterman et al. | 42/124 |
| 6,606,813 | B1 * | 8/2003 | Squire et al. | 42/90 |
| 6,931,778 | B1 * | 8/2005 | Nelson et al. | 42/120 |
| 7,077,582 | B2 * | 7/2006 | Johnson | 396/428 |
| 7,370,449 | B1 * | 5/2008 | Beckmann | 42/90 |
| 7,562,485 | B2 * | 7/2009 | Newhall et al. | 42/127 |
| 2008/0216380 | A1 * | 9/2008 | Teetzel | 42/127 |
| 2011/0167703 | A1 * | 7/2011 | Deros | 42/90 |

OTHER PUBLICATIONS

Thummel, "Dual Beam Laser Module", U.S. Appl. No. 10/802,115, filed Mar. 13, 2004.

* cited by examiner

*Primary Examiner* — Gabriel Klein
(74) *Attorney, Agent, or Firm* — McKay and Hodgson, LLP; Phillip McKay

(57) ABSTRACT

A floating side rail clamp weapon accessory mount adaptor includes a stationary side rail clamp, a floating side rail clamp, and a leaf spring system that replaces prior art biasing plates. The floating side rail clamp moves as a single unit under evenly increasing influence provided by the leaf spring system coupled to the floating side rail clamp. The floating side rail clamp moves as a single unit such that a floating side rail clamp engagement surface of the floating side rail clamp remains substantially parallel to corresponding portion of a stationary side rail clamp engagement surface of the stationary side rail clamp as the floating side rail clamp moves, as a unit, towards the stationary side rail clamp in a direction substantially perpendicular to the stationary side rail clamp engagement surface.

15 Claims, 24 Drawing Sheets

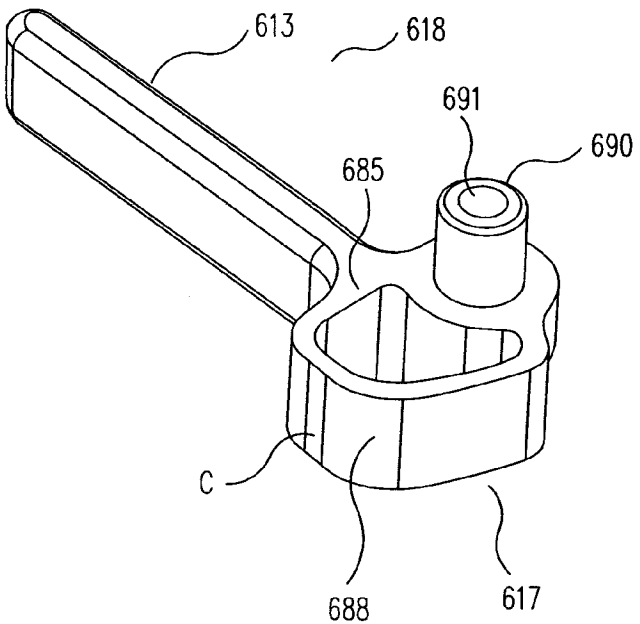
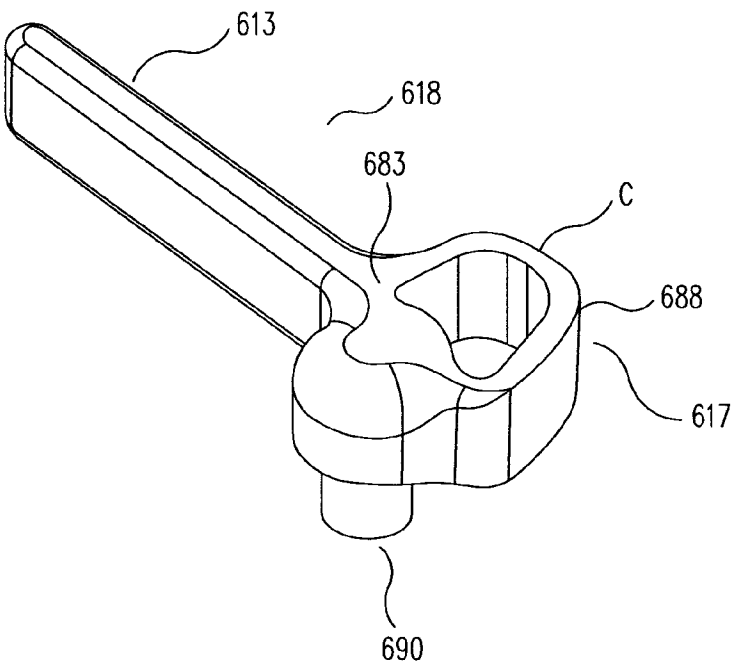
FIG. 6P

FLOATING SIDE RAIL CLAMP WEAPON ACCESSORY MOUNT ADAPTOR

BACKGROUND

One of the most desirable features for a modern weapon is that the weapon be capable of relatively easy modification in the field to adapt to multiple types of tactical situations/scenarios. One way in which modern weapons system manufacturers provide this flexibility is by producing weapons systems that can accommodate one or more weapon accessories such as, but not limited to: visible and non-visible spectrum LASER pointing devices; visible and non-visible spectrum LASER target illumination/identification devices; visible and non-visible spectrum LASER range finding systems; visible and non-visible spectrum illumination systems; mechanical or "iron" sighting systems; magnified and/or non-magnified optical sights and/or quick target acquisition devices; visible and/or non-visible spectrum user identification devices; maintenance and/or weapons status tracking devices; user/unit identification and/or position identification/monitoring devices; communication and/or command and control devices; and/or any one or more of the numerous other weapons accessories that are currently available, and/or known in the art at the time of filing, and/or are developed after the time of filing.

One conventional way to provide this desired level of weapon flexibility is to provide the capability to attach, remove, and/or change-out, one or more weapon accessories on a given weapon, preferably in the field and without the use of tools. To this end, in order to accommodate one or more weapon accessories, i.e., to provide a mechanism for integrating one or more of these weapon accessories with a given weapon, modern weapons manufacturers often include, or at least ensure their weapons are compatible with, one or more universal/standardized weapon accessory mounting systems, herein also referred to as "weapon accessory mounting systems". Some examples of well known weapon accessory mounting systems include, but are not limited to, the military standard MIL-STD-1913 AR Picatinny weapon accessory mounting system, herein also referred to as a "Picatinny rail", and the Weaver weapon accessory mounting system, herein also referred to as a "Weaver rail".

As discussed in more detail below, typical weapon accessory mounting systems include a weapon accessory mounting system rail body and a weapon accessory mount adaptor. A typical weapon accessory mounting system rail body includes a rail body seating/mounting surface which is designed to conform/couple to a corresponding mounting area of a given weapon such as, but not limited to: the weapon's barrel; a heat shield for the weapon's barrel; a carry handle for the weapon; a pistol, forward, or other, grip on the weapon; a stock for the weapon; or virtually any other surface/fixture of the weapon having a suitable mounting area. In one example, using the rail body seating/mounting surface, the weapon accessory mounting system rail body is secured to become an integral part of the weapon.

A typical weapon accessory mounting system rail body also includes one or more rail body weapon accessory mounting surfaces, often on a surface of the weapon accessory mounting system rail body opposing, or at an another angle from, the rail body seating/mounting surface. Typically each rail body weapon accessory mounting surface, in turn, has located thereon, or therein, a plurality of rail weapon accessory mounting surface crossbars, often of a generally T-shaped cross-section, extending perpendicular to the weapon accessory rail body's length that form, and are interspersed with, flat "recoil channels" or "recoil grooves". The rail weapon accessory mounting surface crossbars are often provided with visual location indicia (e.g. marks, numbers, or letters) and therefore provide a reference point so that specific locations along the rail body may be reliably located. In some instances, these reference points are used to allow a user to attach a given weapon accessory to the same location on the weapon each time the weapon accessory is attached.

As noted above, typical weapon accessory mounting systems include a weapon accessory mounting system rail body and a weapon accessory mount adaptor. Typically, a given weapon accessory is attached to at least a portion of the rail body weapon accessory mounting surface using the weapon accessory mount adaptor. The weapon accessory mount adaptor is typically attached to the weapon accessory at one surface, and to at least a portion of the rail body weapon accessory mounting surface at another, typically opposing, surface. Typically, the weapon accessory mount adaptor is itself removably attached to the weapon accessory. In addition, in some instances, the weapon accessory, and/or the weapon accessory mount adaptor, includes a weapon accessory mounting surface capable of providing an attachment point for a second weapon accessory mount adaptor and weapon accessory.

Weapon accessory mount adaptors typically include weapon accessory mount adaptor side rails that mate with one or more edges of the rail body weapon accessory mounting surface and a weapon accessory mount adaptor crossbar that is seated in the between two adjacent rail weapon accessory mounting recoil channel surface crossbars on the rail body weapon accessory mounting surface.

In order to provide truly interchangeable accessories and systems, the physical dimensions of the each weapon accessory mounting system, including the physical dimensions of the weapon accessory mounting system rail body and the weapon accessory mount adaptor, are "standardized" such that for any given weapon accessory mounting system, the dimensions are the same, within defined tolerances.

As an example, for both the Picatinny rail and the Weaver rail systems the width of the rail weapon accessory mounting surface crossbars should be 0.835 inches (within a tolerance of 0.005 inches for the Picatinny rail). However, the Picatinny rails have a recoil channel width of 0.206 inches (within a tolerance of 0.008 inches) and the spacing between recoil channel centers is 0.394 inches (within a tolerance of 0.008 inches). In contrast, Weaver rails have a recoil channel width of 0.180 inches and are not necessarily consistent in the spacing of recoil channel centers. Because of this, Weaver rail weapon accessory mount adaptors will fit on Picatinny rails, but Picatinny rail weapon accessory mount adaptors will not always fit on Weaver rails.

FIG. 1 shows one example of a currently available weapon accessory mounting system rail body 100 that, in this specific example, is a weapon accessory mounting system Picatinny rail body. As seen in FIG. 1, weapon accessory mounting system rail body 100 includes weapon accessory mounting system body 103 having rail body seating/mounting surface 105 that attaches weapon accessory mounting system rail body 100 to a mounting area of a given weapon (not shown in FIG. 1). In this specific example, weapon accessory mounting system rail body 100 is mounted as, and/or replaces, a heat shield surrounding at least a portion of the weapon's barrel.

As seen in FIG. 1, in this example, weapon accessory mounting system rail body 100 includes four weapon accessory mounting rails; a top rail (TR), a bottom rail (BR), a right rail (RR), and a left rail (LR). In FIG. 1, only top rail (TR) and left rail (LR) can be seen in their entirety. Consequently, in the following discussion, top rail (TR) and left rail (LR) will be used as the primary examples, however, those of skill in the art will readily recognize that the following discussion applies to bottom rail (BR) and right rail body (RR) as well.

As can also be seen in FIG. 1, in this specific example, top rail (TR) includes top rail weapon accessory mounting surface 151 and left rail (LR) includes left rail weapon accessory mounting surface 161. As also seen in FIG. 1, in this specific example, top rail weapon accessory mounting surface 151 includes multiple top rail weapon accessory mounting surface crossbars 107 which extend perpendicular to the length of top rail (TR) and are of a generally "T" shaped cross-section (see FIG. 5). In this example, top rail weapon accessory mounting surface crossbars 107 are separated from each other by a distance DRT such that they form recoil channels "G". Also shown in FIG. 1 are left edge E1 of top rail (TR) and right edge E2 of top rail (TR).

As also seen in FIG. 1, in this specific example, left rail weapon accessory mounting surface 161 of left rail (LR) includes multiple left rail weapon accessory mounting surface crossbars 109 which extend perpendicular to the length of left rail (LR). In this example left rail weapon accessory mounting surface crossbars 109 are also separated from each other by a distance DRT such that they form recoil channels "G".

As discussed below, top rail weapon accessory mounting surface 151 of top rail (TR) and left rail weapon accessory mounting surface 161 of left rail (LR), allow for the attachment of one or more weapon accessory mount adaptors, and associated/attached weapon accessories, (not shown in FIG. 1).

Referring now to FIGS. 2, 3 and 4, a prior art weapon accessory mount adaptor 200 employed as part of a weapon accessory mounting system for mounting a weapon accessory to a weapon accessory mounting system rail body, such as weapon accessory mounting system rail body 100 of FIG. 1, is shown.

Referring to FIG. 2, prior art weapon accessory mount adaptor 200 includes a weapon accessory mount adaptor body 203 framed by weapon accessory mount fixed adaptor side rail 205 and weapon accessory mount fixed adaptor side rail 207. As seen in FIG. 2, weapon accessory mount fixed adaptor side rail 207 includes a beveled edge forming a groove 209 which is engagable with an edge of a rail body of a weapon accessory mounting system, such as edges E1 and/or E2, of top rail (TR) of weapon accessory mounting system rail body 100 of FIG. 1. As seen in FIG. 2 and FIG. 3, weapon accessory mount fixed adaptor side rail 205 also includes a biasing plate recess 216 (FIG. 3) through which a surface of a cam 217 (FIGS. 2 and 3) communicates with a biasing plate 229 (FIG. 3). Cam 217 is, in turn, attached to a cam lever 213 used to rotate cam 217 and thereby bias biasing plate 229.

In many prior art examples, biasing plate 229 is formed as a separate structure from side rail 205 and has a length along biasing plate pivot axis 230 (FIG. 3) that is only a fraction of the length of weapon accessory mount fixed adaptor side rail 205. In other prior art examples, biasing plate has a length along biasing plate pivot axis 230 that is longer, and, in some cases, is equal to the length of weapon accessory mount fixed adaptor side rail 205. Typically, biasing plate 229 is free to pivot, in some cases up to 180 degrees, around biasing plate pivot axis 230 (FIG. 3) in either the direction shown by arrow 231 or the direction shown by arrow 233, depending on the bias applied by cam 217 and/or gravity. In typical operation, a surface of cam 217 engages biasing plate 229 in order to selectively pivot biasing plate 229 thereby putting bias on biasing plate 229 against a surface of an edge of a weapon accessory mounting system rail body of a weapon accessory mounting system, such as edges E1 and/or E2 of top rail (TR) of weapon accessory mounting system rail body 100 of FIG. 1.

More specifically, referring to FIGS. 1, 2 and 3 together, cam 217 may be operated via cam lever 213 to pivot biasing plate 229 in direction 231 against an edge E1 and/or E2 of top rail (TR) of weapon accessory mounting system rail body 100 of FIG. 1 such that biasing plate 229 and groove 209 are forced onto an edge, such as E1 and/or E2, of a rail body, such as rail body top rail (TR) of weapon accessory mounting system rail body 100 of FIG. 1, and secure prior art weapon accessory mount adaptor 200 thereon.

As discussed in more detail below, in the prior art, cam 217 is typically designed to be operated via cam lever 213 such that when cam 217 is in a "fully-locked position", cam lever 213 is rotated to a "past center position" or "over center position".

As also seen in FIG. 3, prior art weapon accessory mount adaptor 200 also typically includes a single weapon accessory mount adaptor crossbar 250 that, as discussed below, is designed to be positioned in a recoil channel between two consecutive rail weapon accessory mounting surface crossbars of a rail body of a weapon accessory mounting system, such as in recoil channel "G" of top rail weapon accessory mounting surface crossbars 107 of top rail (TR) of weapon accessory mounting system rail body 100 in FIG. 1.

As also seen in FIG. 3, prior art weapon accessory mount adaptor 200 includes mounting screw holes 261 and 271 that are used to attach prior art weapon accessory mount adaptor 200 to a weapon accessory (not shown in FIG. 3).

Referring to FIGS. 1, 2, and 3, in order to properly, and securely, attach prior art weapon accessory mount adaptor 200 to a rail body weapon accessory mounting surface, such as top rail weapon accessory mounting surface 151 (FIG. 1), prior art weapon accessory mount adaptor 200 must:

1.) Be positioned so at least a portion of one edge of a rail body weapon accessory mounting surface, such as edge E1 of top rail weapon accessory mounting surface 151 in FIG. 1, is in groove 209 and in physical contact with weapon accessory mount fixed adaptor side rail 207; and 2.) Be positioned so at least a portion of weapon accessory mount fixed adaptor side rail 205 and/or biasing plate 229 is in physical contact with at least a portion of a second edge of a rail body weapon accessory mounting surface, such as edge E2 of top rail weapon accessory mounting surface 151 in FIG. 1, that is typically opposite the first edge; and 3.) Be positioned such that single weapon accessory mount adaptor crossbar 250 is positioned in a recoil channel between two consecutive rail weapon accessory mounting surface crossbars of the rail body of the weapon accessory mounting system, such as in a recoil channel "G" between two consecutive top rail weapon accessory mounting surface crossbars 107 in FIG. 1.

Once prior art weapon accessory mount adaptor 200 is properly positioned with respect to a desired rail body weapon accessory mounting surface, such as top rail weapon accessory mounting surface 151 (FIG. 1), cam lever 213 is operated to engage cam 217 against biasing plate 229 thereby causing biasing plate 229 to rotate in direction 231 around biasing plate pivot axis 230 and against the second edge of the rail body weapon accessory mounting surface, such as edge E2 of top rail weapon accessory mounting surface 151 in FIG. 1. In addition, the rotation of biasing plate 229 in direction 231 around biasing plate pivot axis 230 causes the other edge of the rail body weapon accessory mounting surface, such as edge E1 of top rail weapon accessory mounting surface 151 in FIG. 1, to be pressed into groove 209 and be in physical contact with weapon accessory mount fixed adaptor side rail 207, thus, in theory, firmly securing prior art weapon accessory mount adaptor 200 in place on top rail weapon accessory mounting surface 151 and weapon accessory mounting system rail body 100.

FIG. 4 is a side plan view of prior art weapon accessory mount adaptor 200 of FIG. 2 having a weapon accessory 401 mounted thereon and shown attached to top rail weapon accessory mounting surface 151 of top rail (TR) of weapon accessory mounting system rail body 100 of FIG. 1. As noted above, weapon accessories such as weapon accessory 401 of FIG. 4, can be, but are not limited to, any one or more of: visible and non-visible spectrum LASER pointing devices; visible and non-visible spectrum LASER target illumination/identification devices; visible and non-visible spectrum LASER range finding systems; visible and non-visible spectrum illumination systems; mechanical or "iron" sighting systems; magnified and/or non-magnified optical sights and/or quick target acquisition devices; visible and/or non-visible spectrum user identification devices; maintenance and/or weapons status tracking devices; user/unit identification and/or position identification/monitoring devices; communication and/or command and control devices; and/or any one or more of the numerous other weapons accessories that are currently available and/or known in the art at the time of filing, and/or are developed after the time of filing.

Returning to FIG. 4, prior art weapon accessory mount adaptor 200 is shown positioned so at least a portion of edge E1 of top rail weapon accessory mounting surface 151 is in groove 209 (not shown in FIG. 4, see FIG. 3) and in physical contact with weapon accessory mount fixed adaptor side rail 207 (not shown in FIG. 4, see FIG. 3) and positioned so at least a portion of weapon accessory mount fixed adaptor side rail 205 is in physical contact with at least a portion of edge E2 of top rail weapon accessory mounting surface 151 (FIG. 4). In addition, in FIG. 4, prior art weapon accessory mount adaptor 200 is positioned such that single weapon accessory mount adaptor crossbar 250 (not shown in FIG. 4, see FIG. 3) is positioned in a recoil channel "G" (not shown in FIG. 4, See FIG. 3) between two consecutive top rail weapon accessory mounting surface crossbars 107.

In addition, in FIG. 4, lever 213 is shown engaged and locking cam 217 against biasing plate 229 (not shown in FIG. 4, see FIG. 3) thereby causing biasing plate 229 to rotate in direction 231 around biasing plate pivot axis 230 (FIG. 3) and against edge E2 of top rail weapon accessory mounting surface 151 (FIG. 4). In addition, the rotation of biasing plate 229 to rotate in direction 231 around biasing plate pivot axis 230 causes the other edge of the rail body weapon accessory mounting surface, such as edge E1 (not shown in FIG. 4, see FIG. 3) of top rail weapon accessory mounting surface 151, to be pressed into groove 209 (not shown in FIG. 4, see FIG. 3) and be in physical contact with weapon accessory mount fixed adaptor side rail 207 (not shown in FIG. 4, see FIG. 3), thus, in theory, firmly securing prior art weapon accessory mount adaptor 200 in place on top rail weapon accessory mounting surface 151 and weapon accessory mounting system rail body 100 (FIG. 4).

FIG. 5 shows a cross-section of an exemplary rail weapon accessory mounting surface crossbar 507, such as any of top rail weapon accessory mounting surface crossbars 107 in FIG. 1. As seen in FIG. 1, rail weapon accessory mounting surface crossbar 507 is of a general "T" shape with tapered, or chamfered, surfaces 509 forming edges E1 and E2. As seen in FIG. 5, and in FIG. 1, and as discussed above, the width "W" of rail weapon accessory mounting surface crossbar (507 in FIG. 5) between edges E1 and E2 is specified by the Picatinny rail standard to be 0.835 inches with a tolerance of 0.005 inches. As a result, the total maximum variance between the width "W" of rail weapon accessory mounting surface crossbars for any two rail body weapon accessory mounting surfaces of any two Picatinny rail weapon accessory mounting systems is 0.005 inches. Also shown in FIG. 5 are various exemplary dimensions associated with one exemplary embodiment.

Returning to FIG. 3, as noted above, in many embodiments biasing plate 229 is typically free to pivot up to 180 degrees around biasing plate pivot axis 230 (FIG. 3) in either the direction shown by arrow 231 or the direction shown by arrow 233 in FIG. 3. However, biasing plate 229 typically remains in a fixed parallel position with respect to weapon accessory mount fixed adaptor side rail 205, i.e., biasing plate 229 does not move in either direction 243 or 241 but rather only pivots on biasing plate pivot axis 230. Consequently, if prior art weapon accessory mount adaptor 200, and a weapons accessory (not shown) that is attached to prior art weapon accessory mount adaptor 200, is to be mounted on a given weapon accessory mounting system rail body, such as weapon accessory mounting system rail body 100, then the perpendicular distance "P" (FIG. 3) between weapon accessory mount fixed adaptor side rail 205 and weapon accessory mount fixed adaptor side rail 207 must be kept very close to the width "W" of the rail weapon accessory mounting surface crossbars (507 in FIG. 5 and 107 in FIG. 1) between edges E1 and E2. In other words, since biasing plate 229 does not move in either direction 243 or 241 the ability of prior art weapon accessory mount adaptor 200 to accommodate more than even the slightest variance in width "W" of a the rail weapon accessory mounting surface crossbars (507 in FIG. 5 and 107 in FIG. 1) between edges E1 and E2 is very limited. However, as noted above, a tolerance of 0.005 inches in width "W" is specified by the Picatinny rail standard and, as a result, the total maximum variance between the width "W" of rail weapon accessory mounting surface crossbars for any two rail weapon accessory mounting surfaces of any two Picatinny rail weapon accessory mounting systems is 0.005 inches.

In addition, returning to FIG. 3, as noted above, in many embodiments biasing plate 229 is typically free to pivot up to 180 degrees around biasing plate pivot axis 230 (FIG. 3) in either the direction shown by arrow 231 or the direction shown by arrow 233 in FIG. 3. However, there is no return force causing biasing plate 229 to fully open automatically. Consequently, biasing plate 229 is often not in the fully open position. As a result, prior art weapon accessory mount adaptor 200 often can not be attached a rail body weapon accessory mounting surface, such as top rail weapon accessory mounting surface 151, by bringing the prior art weapon accessory mount adaptor 200 straight down onto the rail body weapon accessory mounting surface along an axis perpendicular to the rail body weapon accessory mounting surface, as would be intuitively done. Instead, accessory mount adaptor 200 is typically attached to a rail body weapon accessory mounting surface, such as top rail weapon accessory mounting surface 151, by first engaging a first edge of the desired rail body of the weapon accessory mounting system, such as edge E1 of top rail weapon accessory mounting surface 151, with groove 209 of weapon accessory mount fixed adaptor side rail 207 at an angle or "tilted" and then "rolling and snapping" weapon accessory mount fixed adaptor side rail 205, and biasing plate 229 onto a second, opposite, edge of the rail body of the weapon accessory mounting system, such as edge E2 of top rail weapon accessory mounting surface 151.

In addition, while performing this "tilt, roll, and snap" attachment procedure, the user must be careful to ensure that weapon accessory mount adaptor crossbar 250 is aligned and positioned in a recoil channel between consecutive rail weapon accessory mounting surface crossbars of the rail body of the weapon accessory mounting system, such as in recoil channel "G" of two consecutive rail weapon accessory mounting surface crossbars 107 of top rail weapon accessory mounting surface 151. This procedure is referred to herein as an "align, tilt, roll, and snap" attachment method.

The "align, tilt, roll, and snap" method for attaching prior art weapon accessory mount adaptor 200 to a rail body weapon accessory mounting surface, such as top rail weapon accessory mounting surface 151, is relatively difficult and awkward, even under the best, and most relaxed, conditions. However, when in the field, or worse yet, under fire, attaching prior art weapon accessory mount adaptor 200 to a weapon accessory mounting system using the "align, tilt, roll, and snap" becomes unacceptably difficult, time consuming, error prone, and potentially life threatening.

In addition, the "align, tilt, roll, and snap" method for attaching prior art weapon accessory mount adaptor 200 to a rail body weapon accessory mounting surface, such as top rail weapon accessory mounting surface 151 makes it difficult for the user to determine when, and if, prior art weapon accessory mount adaptor 200 is properly aligned and/or engaged. Consequently, users often attempt to engage cam lever 213 and lock cam 217 before prior art weapon accessory mount adaptor 200 is properly seated.

In addition, the "align, tilt, roll, and snap" method for attaching prior art weapon accessory mount adaptor 200 to a rail body weapon accessory mounting surface, such as top rail weapon accessory mounting surface 151, often results in uneven stresses on: the edge of the desired rail body of the weapon accessory mounting system, such as edge E1 of top rail weapon accessory mounting surface 151; the inner surface of groove 209 of weapon accessory mount fixed adaptor side rail 207; weapon accessory mount fixed adaptor side rail 205, and biasing plate 229; and the second, opposite, edge of the rail body of the weapon accessory mounting system, such as edge E2 of top rail weapon accessory mounting surface 151. These uneven stresses not only produce increased wear and tear on the weapon accessory mounting systems, and the associated weapons accessories, but they also cause misalignment of the weapons accessories with the desired weapon and/or barrel axis. In the case of, for instance, LASER pointing and target illumination systems, iron sighting system, or optical sighting systems, this misalignment can greatly reduce the capabilities of the weapon and, in some cases, make the weapon useless for its intended purpose and/or the mission.

In addition, since prior art weapon accessory mount adaptors 200 (FIG. 2) and 400 FIGS. 4A to 4C) rely solely on a single cam surface of cams 217 and 417, respectively, such as cam surface 218 in FIG. 3 and cam surface 410 of FIGS. 4A to 4C, to apply the required bias/force the single cam surface 218 in FIG. 3 and cam surface 410 of FIGS. 4A to 4C still applies a biasing pressure abruptly and unevenly distributed. In many instances this unevenly distributed force pulls weapon accessory mount fixed adaptor side rail 205 down so that the entire prior art weapon accessory mount adaptor 200 is tilted down on the mount fixed adaptor side rail 205 side. This again creates uneven stresses on the weapon accessory mounting system and an uneven sight picture.

In addition, the limited ability of prior art weapon accessory mount adaptor 200 to accommodate variance in the width "W" of a the rail weapon accessory mounting surface crossbars (507 in FIG. 5 and 107 in FIG. 1) between edges E1 and E2 means that even when the awkward, and often difficult, "align, tilt, roll, and snap" method for attaching prior art weapon accessory mount adaptor 200 to a rail body weapon accessory mounting surface is performed correctly, proper attachment will occur only if the width "W" is within very tight tolerances of an established specification and any deviance outside these tight tolerances will mean that prior art weapon accessory mount adaptor 200 cannot be properly attached, or detached, at all, by any method.

This is particularly problematic given that weapon accessory mounting rails are often mass produced, and/or provided by after-market suppliers, and therefore often have significant variations in all dimensions, including the width "W". In addition, as noted above, even if the Picatinny rail standard is diligently applied by the manufacturer, a tolerance of plus or minus 0.005 inches in width "W" is still acceptable so that two examples of weapon accessory mounting rails produced, even by the most careful adherence to the Picatinny rail standard, can still have a total maximum variance between the width "W" of 0.005 inches. This is not a particularly insignificant variance, and this is before being subjected to any wear and tear in the field.

In addition, as field weapons systems, many weapon accessory mounting systems are subjected to significant wear and tear in the field and this wear and tear often results in damage and/or variations in dimensions of the weapon accessory mounting rails, including the width "W".

Feedback from users in the field indicates that the limited ability of prior art weapon accessory mount adaptor 200 to accommodate variance in the width "W" of a the rail weapon accessory mounting surface crossbars (507 in FIG. 5 and 107 in FIG. 1) between edges E1 and E2 is a very real and significant problem. For instance, if the width "W" of the rail weapon accessory mounting surface crossbars (507 in FIG. 5 and 107 in FIG. 1) between edges E1 and E2 is too wide, either due to manufacturing variations or to minor field damage, then cam lever 213 (FIG. 3 and FIG. 4) cannot be fully closed, or "locked". This is even more problematic given that many prior art cams and cam levers rely on an "over center" position or "locked" position as discussed above with respect to FIG. 4C.

As a result, cam lever 213 can catch on objects in the field and be flipped open, or simply work lose. This, in turn, means prior art weapon accessory mount adaptor 200 can potentially come loose, thereby ruining any alignment of the attached weapon accessory with the weapon, which can be critical, and/or allowing the attached weapon accessory to fall off. Not only does this potentially deprive a solider or law enforcement officer in the field of the desired weapon accessory capability, potentially at the time it is needed most, but it can also result in an opponent/enemy detecting the presence of the solider or law enforcement officer when the weapon accessory drops off and is found. In addition, if the width "W" is too wide, yet cam lever 213 is somehow forced fully closed, over center, or "locked" position, it may then be impossible to remove and/or exchange the weapon accessory in the field, thereby negating the field flexibility that motivated the use of the weapon accessory mounting system in the first place.

On the other hand, if the width "W" of the rail weapon accessory mounting surface crossbars (507 in FIG. 5 and 107 in FIG. 1) between edges E1 and E2 is too narrow, either due to manufacturing variations or to minor field damage, then cam lever 213 can be fully closed, and therefore the user may think the weapon accessory is securely attached, but in reality, the weapon accessory mount adaptor, and the weapon accessory, will not be properly secured to the weapon. As a result, prior art weapon accessory mount adaptor 200 is often loose at the time of attachment, thereby immediately ruining any alignment of the attached weapon accessory with the weapon, and/or allowing the attached weapon accessory to fall off.

Another problem associated with currently available weapon accessory mount adaptors, such as prior art weapon accessory mount adaptor 200, is that there is typically only one weapon accessory mount adaptor crossbar 250 (FIG. 3). Consequently, prior art weapon accessory mount adaptor 200, and the attached weapon accessory, is often free to "piston" back and forth within the single recoil channel "G" containing the single weapon accessory mount adaptor crossbar 250 during shot recoil. In addition, when there is typically only one weapon accessory mount adaptor crossbar 250 (FIG. 3) the attached weapon accessory, is often free to pivot at least the distance allowed by the specification tolerances. This is particularly problematic when biasing plates are used, such as in FIG. 2, as opposed to floating rails, such as in FIGS. 4A to 4C.

Some more recent weapon accessory mounting system, such as weapon accessory mount adaptor 400 of FIGS. 4A to 4C, include a weapon accessory mount adaptor that has a biasing element that can move limited distances with respect to the opposing weapon accessory mount adaptor side rail, i.e., can move in either direction 243 or 241 in FIG. 3 or in direction 416 in FIGS. 4A to 4C. For instance, U.S. Pat. No. 6,606,813 issued to Squire et. al. on Aug. 19, 2003, herein the '813 patent, appears to include a biasing element that can move limited distances in a direction parallel with respect to the opposing weapon accessory mount adaptor side rail. However, these prior art weapon accessory mount adaptors including parallel biasing plate movement, such as discussed in the '813 patent, still include biasing and returning force elements that are structures separate from the side rail, and/or are not in operable contact with the floating side rail, such as Bellville washer spring system 420 in FIGS. 4A to 4C. In addition, Bellville washer spring system 420 of FIGS. 4A to 4C is positioned on fixed side rail 409 and exerts its force indirectly on floating side-rail 407. Consequently, these prior art weapon accessory mount adaptors including parallel biasing plate movement still apply biasing pressure in a uneven manner, as opposed to a far more desirable evenly increasing pressure, and therefore create uneven stresses, which as discussed above, not only produce increased wear and tear on the weapon accessory mounting systems, and the associated weapons accessories, but they also cause misalignment of the weapons accessories with the desired weapon and/or barrel axis.

In addition, as discussed in more detail below, in the prior art, cam 217 (FIG. 2) and cam 417 (FIG. 4A) are typically designed to be operated via cam lever 213 (FIG. 2) and cam lever 417 (FIG. 4A) such that when cam 217 (FIG. 2) and cam 417 (FIG. 4A) is in a "fully-locked position", cam lever 213 (FIG. 2) and cam lever 417 (FIG. 4A) is rotated to a "past center position" or "over center position".

FIGS. 4A to 4C show one example of a generic exemplary cam 417 of a second type of weapon accessory mount adaptor 400 being rotated into an "over center position" fully locked condition (see FIG. 4C).

As seen in FIG. 4A, initially cam 417 is in the "open" position such cam lever axis 414 is more or less perpendicular to a line 406 that runs parallel to length FL of floating side-rail 407 and open point "O" of contact surface 410 of cam 417 is in contact with floating side-rail 407.

FIG. 4B shows cam 417 after having been rotated in direction 412 by cam lever 413 to a "center" position such that cam lever axis 414 is more or less parallel to line 406 that runs parallel to length FL of floating side-rail 407 and center point "C" of contact surface 410 of cam 417 is in contact with floating side-rail 407. In this specific illustrative example, the rotation of cam lever 413 and cam 417 to the center position causes floating side-rail 407 to move in a direction 416 towards fixed side rail 409 along column 418 and under a force created by Bellville washer spring system 420. It is worth noting that Bellville washer spring system 420 is positioned on fixed side rail 409 and exerts its force indirectly on floating side-rail 407. In this specific illustrative example, after cam 417 has been rotated in direction 412 by cam lever 413 to the center position, Bellville washer spring system 420 is compressed such that distance 422 is about 0.012 inches.

FIG. 4C shows cam 417 after having been rotated further in direction 412 by cam lever 413 to a "locked" position such that cam lever axis 414 is at an angle 434 to line 406 that runs parallel to length FL of floating side-rail 407 and locked point "L" of contact surface 410 of cam 417 is in contact with floating side-rail 407 such that cam 417 is in an "over center position". In this specific illustrative example, the rotation of cam lever 413 and cam 417 to the over center and fully locked position causes floating side-rail 407 to lock into the closed position and Bellville washer spring system 420 to be relieved from fully compressed such that distance 422 is relieved from the 0.012 inches of FIG. 4B by 0.002 to 0.004 inches in FIG. 4C.

While the rotation of cam 417 by cam lever 413 to an over center "locked position" serves to secure the cam lever and lock floating side-rail 407 in the closed position, the rotation to the over center position actually relives some of the pressure securing floating side-rail 407 and requires considerable force and can make it quite difficult to rotate cam lever 413 and cam 417 back to the open position of FIG. 4A. Consequently, the use of, and need for, an over center locked position for cam 417 is not ideal.

Due, in large part, to the shortcomings of the prior art weapon accessory mount adaptors discussed above, weapons users, including soldiers and law enforcement officers in the field, are currently employing weapon accessory mounting systems that are too difficult to use, and have very little tolerance for dimensional variation and combat damage. Therefore, prior art weapon accessory mount adaptors are not providing weapons accessory capability that is as versatile and combat effective as would be desired.

SUMMARY

In accordance with one embodiment, a floating side rail clamp weapon accessory mount adaptor includes a stationary side rail clamp, a movable floating side rail clamp, and a leaf spring system, directly and operable coupled to the floating side rail clamp, that replaces the prior art biasing plates. In one embodiment, the floating side rail clamp moves as a single unit under evenly increasing force provided by the leaf spring system that applies the force directly to the floating side rail. In one embodiment, the floating side rail clamp moves as a single unit such that a floating side rail clamp engagement surface remains substantially parallel to a corresponding portion of a stationary side rail clamp engagement surface as the floating side rail clamp moves, as a unit, towards the stationary side rail clamp in a direction substantially perpendicular to the stationary side rail clamp engagement surface.

In one embodiment, the floating side rail clamp weapon accessory mount adaptor is attached to at least a portion of a rail body weapon accessory mounting surface, such as a Picatinny rail, using the stationary side rail clamp, the floating side rail clamp, and a leaf spring system as discussed in more detail below.

In one embodiment the floating side rail clamp weapon accessory mount adaptor is also attached to a weapons accessory. In one embodiment the floating side rail clamp weapon accessory mount adaptor is removably attached to the weapon accessory. In other instances, the floating side rail clamp weapon accessory mount adaptor is formed as an integral part of the weapon accessory. In addition, in some instances, the floating side rail clamp weapon accessory mount adaptor itself includes a weapon accessory mounting surface capable of providing an attachment point for a second floating side rail clamp weapon accessory mount adaptor.

In one embodiment, the floating side rail clamp weapon accessory mount adaptor includes a floating side rail clamp weapon accessory mount adaptor body. In one embodiment, the floating side rail clamp weapon accessory mount adaptor body includes a stationary side rail clamp formed integrally on a first side of the floating side rail clamp weapon accessory mount adaptor body. In one embodiment, the stationary side rail clamp includes a stationary side rail clamp engagement surface that runs along at least a portion of the length of the stationary side rail clamp. In one embodiment, the stationary side rail clamp engagement surface of the stationary side rail clamp is a stationary side rail clamp groove formed by a beveled edge designed to engage a first edge of a rail body weapon accessory mounting surface, such as an edge of one or more crossbars of a Picatinny rail body weapon accessory mounting surface.

In one embodiment, the floating side rail clamp weapon accessory mount adaptor includes one or more floating side rail clamp weapon accessory mount adaptor crossbars. In one embodiment, each of the one or more floating side rail clamp weapon accessory mount adaptor crossbars is designed to be positioned between two consecutive rail weapon accessory mounting surface crossbars in a respective recoil channel. In one embodiment, two or more floating side rail clamp weapon accessory mount adaptor crossbars are used to help minimize, and/or eliminate, the piston action associated with prior art weapon accessory mount adaptors, discussed above, by providing two separate floating side rail clamp weapon accessory mount adaptor crossbar contacts with two separate recoil channels in the rail body weapon accessory mounting surface.

In one embodiment, the floating side rail clamp weapon accessory mount adaptor includes a floating side rail clamp movably retained with respect to the floating side rail clamp weapon accessory mount adaptor body. In one embodiment, the floating side rail clamp includes a floating side rail clamp engagement surface that runs along at least a portion of the length of a floating side rail clamp first surface. In one embodiment, the floating side rail clamp includes a floating side rail clamp second surface that is opposite the floating side rail clamp first surface and floating side rail clamp engagement surface. In one embodiment, the floating side rail clamp second surface is coupled to, and subject to leaf spring engagement force from, the leaf spring assembly directly.

In one embodiment, the floating side rail clamp engagement surface of the floating side rail clamp first surface is a floating side rail clamp groove formed by a beveled edge designed to engage a second edge of a rail weapon accessory mounting surface that is opposite the first edge of the rail weapon accessory mounting surface.

In embodiment, the floating side rail clamp is movably retained with respect to the floating side rail clamp weapon accessory mount adaptor body such that the floating side rail clamp can move along an axis perpendicular to the stationary side rail clamp engagement surface of the stationary side rail clamp. In embodiment, the floating side rail clamp is movably retained with respect to the floating side rail clamp weapon accessory mount adaptor body such that the floating side rail clamp can move along the axis perpendicular to the stationary side rail clamp engagement surface of the stationary side rail clamp such that the entire floating side rail clamp engagement surface of the floating side rail clamp remains substantially parallel to the stationary side rail clamp engagement surface of the stationary side rail clamp while moving along the axis perpendicular to the stationary side rail clamp engagement surface of the stationary side rail clamp.

In embodiment, the floating side rail clamp is movably retained with respect to the floating side rail clamp weapon accessory mount adaptor body by two or more floating side rail clamp weapon accessory mount adaptor posts extending through floating side rail clamp weapon accessory mount adaptor post holes formed through the floating side rail clamp. In one embodiment, a first end of the two or more floating side rail clamp weapon accessory mount adaptor posts extend through the floating side rail clamp weapon accessory mount adaptor post holes formed through the floating side rail clamp to the second surface of the floating side rail clamp that is opposite the floating side rail clamp first surface and the floating side rail clamp engagement surface of the floating side rail clamp.

In one embodiment, the two or more floating side rail clamp weapon accessory mount adaptor posts extend lengthwise perpendicular to the stationary side rail clamp engagement surface of the stationary side rail clamp and parallel to an axis perpendicular to the stationary side rail clamp engagement surface of the stationary side rail clamp.

In one embodiment, the two or more floating side rail clamp weapon accessory mount adaptor posts extend through the floating side rail clamp weapon accessory mount adaptor post holes formed through the floating side rail clamp to floating side rail clamp weapon accessory mount adaptor post attachment positions in the floating side rail clamp weapon accessory mount adaptor body.

In one embodiment, the floating side rail clamp weapon accessory mount adaptor includes a floating side rail clamp weapon accessory mount adaptor leaf spring system. In one embodiment, the floating side rail clamp weapon accessory mount adaptor leaf spring system includes one or more leaf springs and a leaf spring engagement means.

In one embodiment the one or more leaf springs each have a first leaf spring end and a second leaf spring end, opposite the first leaf spring end along a length of the leaf spring. In one embodiment, the first leaf spring ends of the one or more leaf springs are in operative contact with a first leaf spring contact point on the second surface of the floating side rail clamp. In one embodiment, the second leaf spring ends of the one or more leaf springs are in operative contact with a second leaf spring contact point on the second surface of the floating side rail clamp that is separated from the first leaf spring contact point along a length of the second surface of the floating side rail clamp.

In one embodiment, the first leaf spring ends of the one or more leaf springs and the second leaf spring ends of the one or more leaf springs are in operative contact with the first leaf spring contact point and the second leaf spring contact point on the second surface of the floating side rail clamp such that when the leaf spring is subjected to an engagement pressure, and is thereby engaged, a leaf spring engagement force is exerted directly on the second surface of the floating side rail clamp in a relatively even manner along the length of the second surface of the floating side rail clamp.

In one embodiment, the leaf spring engagement force along the length of the second surface of the floating side rail clamp causes the entire floating side rail clamp to move as a unit along the two or more floating side rail clamp weapon accessory mount adaptor posts in a direction substantially perpendicular to the stationary side rail clamp engagement surface such that the floating side rail clamp engagement surface of the floating side rail clamp remains substantially parallel to the corresponding portion of a stationary side rail clamp engagement surface.

In one embodiment, the leaf spring engagement means includes a leaf spring engagement surface that operationally engages a leaf spring engagement portion of the one or more leaf springs and thereby provides the engagement pressure required to engage the one or more leaf springs. As discussed in more detail below, in various embodiments, the leaf spring engagement means is manually activated by the user taking an action such as turning a knob or by engaging a quick release lever, or other clamping device.

In one embodiment, the leaf spring engagement means is a cam system including a cam quick release lever attached to a cam such that when the user engages the cam quick release lever with increasing pressure, the cam quick release lever causes the cam to rotate and gradually increase a variable cam radius extending from the rotational axis of the cam to a cam leaf spring engagement surface of the cam that forms a curved outside edge surface of the cam. The cam leaf spring engagement surface, in turn, engages the leaf spring activation surface, thereby gradually, and evenly, increasing the engagement pressure applied to the one or more leaf springs via the leaf spring activation surface.

In one embodiment, the variable cam radius is specially designed as a curve to gradually increase at fractions of the relaxed leaf spring curvature radius that exists when the leaf spring is under no engagement pressure.

In one embodiment, the variable cam radius is specially designed as a curve to gradually increase at fractions of the relaxed leaf spring curvature radius that exists when the leaf spring is under no engagement pressure such that when the floating side rail clamp weapon accessory mount adaptor is in the "fully locked" position, the cam is in the "center position" such that a cam lever extends along cam lever axis more or less parallel to a length of the floating side-rail as opposed to the "over center" position typically used in the prior art.

In one embodiment, the outer engagement surface of the cam that forms a curved outside edge surface of the cam includes a "locked position" engagement surface portion that engages the leaf spring engagement portion of the one or more leaf springs when the cam is in a centered and locked position and thereby provides the engagement pressure to the one or more leaf springs when the cam is the centered and locked position. In one embodiment, the locked position engagement surface portion of the curved outside edge surface of the cam is curved to match the curvature of the one or more leaf springs in the locked position, thereby providing matching surfaces of the same curvature radius in the locked position, i.e., providing a curvature radius of the locked position engagement surface portion of the curved outside edge surface of the cam that matches the curvature radius of the one or more leaf springs in the locked position. Consequently, in this embodiment, the prior art need for an over center locked position is eliminated.

In one embodiment, the floating side rail clamp weapon accessory mount adaptor includes one or more return springs used to apply a returning, or "opening" force on the floating side rail clamp in a direction opposite to the leaf spring engagement force.

In one embodiment, the one or more return springs are coupled to, or fitted around, the two or more floating side rail clamp weapon accessory mount adaptor posts such that the one or more return springs apply the returning, or "opening" force on floating side rail clamp in a direction opposite to the leaf spring engagement force evenly along the length of the second surface of the floating side rail clamp.

In one embodiment, the returning force provided by one or more return springs serves to further ensure that the leaf spring engagement force applied by the leaf spring system is applied evenly, and in a gradual and smoothly increasing manner, along the length of the second surface of the floating side rail clamp so that the entire floating side rail clamp moves as a unit in a direction substantially perpendicular to the stationary side rail clamp engagement surface, along the two or more floating side rail clamp weapon accessory mount adaptor posts, and such that the floating side rail clamp engagement surface of the floating side rail clamp remains substantially parallel to corresponding portion of the stationary side rail clamp engagement surface of the stationary side rail clamp.

In addition, in one embodiment, the returning force provided by the one or more return springs serves to return floating side rail clamp to the fully open position as a default whenever the leaf spring engagement force is released, via user manipulation of the leaf spring engagement means, and hold the floating side rail clamp weapon accessory mount adaptor in the open position with a maximum perpendicular distance "P" between the floating side rail clamp engagement surface of the floating side rail clamp and the corresponding portion of the stationary side rail clamp engagement surface of the stationary side rail clamp. Consequently, the returning force provided by the one or more return springs serves to return floating side rail clamp to a default rapid attachment condition.

The floating side rail clamp weapon accessory mount adaptor, as disclosed herein, includes a stationary side rail and a second side rail that itself is a floating side rail clamp movably retained with respect to the floating side rail clamp weapon accessory mount adaptor body and directly coupled to a biasing leaf spring force. Consequently, according to the floating side rail clamp weapon accessory mount adaptor as disclosed herein, the entire floating side rail clamp can move along an axis perpendicular to the stationary side rail clamp engagement surface of the stationary side rail clamp. This construction means that the floating side rail clamp weapon accessory mount adaptor, as disclosed herein, has several advantages over prior art weapon accessory mount adaptors.

For instance, since the entire floating side rail clamp is movably retained with respect to the floating side rail clamp weapon accessory mount adaptor body, the floating side rail clamp weapon accessory mount adaptor disclosed herein can be opened much wider than prior art biasing plate systems to accommodate a very significant variance in width "W" of a the rail weapon accessory mounting surface crossbars (507 in FIG. 5 and 107 in FIG. 1) between edges E1 and E2. In one embodiment, the disclosed floating side rail clamp weapon accessory mount adaptor can accommodate a variance in width "W" of 0.02 inches, four times the variance allowed by the Picatinny rail standard. As a result the floating side rail clamp weapon accessory mount adaptor disclosed herein can be attached to a rail body weapon accessory mounting surface by bringing the floating side rail clamp weapon accessory mount adaptor disclosed herein straight down onto the rail body weapon accessory mounting surface, without the need for the awkward, and often dangerously difficult, "align, tilt, roll, and snap" method for attaching prior art weapon accessory mount adaptors. Consequently, a weapon accessory mounting system including the floating side rail clamp weapon accessory mount adaptor disclosed herein is easier, and safer, to deploy in the field.

In addition, since the floating side rail clamp weapon accessory mount adaptor disclosed herein can be attached to a rail body weapon accessory mounting surface by bringing the floating side rail clamp weapon accessory mount adaptor straight down onto the rail body weapon accessory mounting surface, none of the uneven stresses associated with the "align, tilt, roll, and snap" method for attaching prior art weapon accessory mount adaptors are created.

In addition, since the floating side rail clamp weapon accessory mount adaptor disclosed herein can be opened much wider than prior systems to accommodate even a very significant variance in width "W" of a the rail weapon accessory mounting surface crossbars, the floating side rail clamp weapon accessory mount adaptor disclosed herein can accommodate rail body weapon accessory mounting surfaces that have significant variance and/or combat/field damage, and have even been manufactured outside of specification. As noted above, in one embodiment, floating side rail clamp weapon accessory mount adaptor disclosed herein can accommodate a variance in width "W" of 0.02 inches, four times the variance allowed by the Picatinny rail standard.

In addition, since the entire floating side rail clamp is movably retained with respect to the floating side rail clamp weapon accessory mount adaptor body, using the floating side rail clamp weapon accessory mount adaptor disclosed herein, the uneven engagement stresses caused by the prior art systems are eliminated and therefore weapon accessory alignments and sight pictures are better preserved.

In addition, since the entire floating side rail clamp is movably retained with respect to the floating side rail clamp weapon accessory mount adaptor body, using the floating side rail clamp weapon accessory mount adaptor disclosed herein, there is less chance that the floating side rail clamp weapon accessory mount adaptor will work loose and degrade the capability, or cause the loss of, the weapon accessory.

In addition, as discussed above, in one embodiment, the one or more leaf springs of the leaf spring assembly of the floating side rail clamp weapon accessory mount adaptor disclosed herein are in operative contact with the second surface of the floating side rail clamp such that when the leaf spring is subjected to an engagement pressure, and is thereby engaged, a leaf spring engagement force is exerted on the second surface of the floating side rail clamp in a relatively even manner along the length of the second surface of the floating side rail clamp and any variance in width "W" of the Picatinny rail is automatically adjusted to without the need for special tools and/or adjustments in the field.

In addition, as discussed above, in one embodiment, the one or more leaf springs of the leaf spring assembly of the floating side rail clamp weapon accessory mount adaptor disclosed herein are in operative contact with the second surface of the floating side rail clamp such that when the leaf spring is subjected to an engagement pressure, and is thereby engaged, a leaf spring engagement force is exerted on the second surface of the floating side rail clamp directly and in a relatively even manner along the length of the second surface of the floating side rail clamp. In this way the floating side rail clamp weapon accessory mount adaptor disclosed herein provides the highly desirable even and steadily increasing engagement pressure that was nearly impossible to achieve with prior art weapon accessory mount adaptors and their associated single cam surface contact points.

In addition, to further enable an even and steadily increasing engagement pressure, in one embodiment, the leaf spring engagement means of the floating side rail clamp weapon accessory mount adaptor disclosed herein is a cam system including a quick release lever attached to a cam such that when the user engages the quick release lever with increasing pressure, the quick release lever causes the cam to rotate and gradually increase a variable cam radius extending from the rotational axis of the cam to the leaf spring engagement surface, thereby gradually, and evenly, increasing the engagement pressure applied to the one or more leaf springs via the leaf spring engagement surface. The leaf springs, in turn, provide a more evenly distributed and smoothly increasing engagement force than is possible using a single cam surface contact point.

In addition, in on embodiment, the variable cam radius is specially designed to increase at specific fractions of the relaxed leaf spring curvature radius that exists when the leaf spring is under no engagement pressure such that when the floating side rail clamp weapon accessory mount adaptor is in the "fully locked" position, the cam is in the "center position" such that a cam lever extends along cam lever axis more or less parallel to a length of the floating side-rail as opposed to the "over center" position typically used in the prior art. Consequently, the floating side rail clamp weapon accessory mount adaptor disclosed herein can be more easily and intuitively locked and opened by the user.

In addition, a returning force is provided by one or more return springs that are incorporated in one embodiment of the floating side rail clamp weapon accessory mount adaptor disclosed herein. This returning force serves to further ensure that the leaf spring engagement force is applied evenly, and in a gradual and smooth manner, along the length of the second surface of the floating side rail clamp so that the entire floating side rail clamp moves as a unit in a direction substantially perpendicular to the stationary side rail clamp engagement surface such that the floating side rail clamp engagement surface of the floating side rail clamp remains substantially parallel to the corresponding portion of a stationary side rail clamp engagement surface.

In addition, in one embodiment, the returning force provided by the one or more return springs serves to return the floating side rail clamp to the fully open position as a default whenever the leaf spring engagement force is released and hold the floating side rail clamp weapon accessory mount adaptor in the ready open position having a maximum perpendicular distance "P" between the floating side rail clamp engagement surface of the floating side rail clamp and the corresponding portion of the stationary side rail clamp engagement surface of the stationary side rail clamp to accommodate even the largest reasonable variance in the width "W" of the rail weapon accessory mounting surface crossbars.

In addition, in one embodiment, the floating side rail clamp weapon accessory mount adaptor disclosed herein includes two or more floating side rail clamp weapon accessory mount adaptor crossbars and/or posts. In one embodiment, each of the two or more floating side rail clamp weapon accessory mount adaptor crossbars and/or posts is designed to be positioned between two consecutive rail weapon accessory mounting surface crossbars in a respective recoil channel. The use of two or more floating side rail clamp weapon accessory mount adaptor crossbars and/or posts helps minimize, and/or eliminate, the piston action discussed above by providing two separate floating side rail clamp weapon accessory mount adaptor crossbar and/or post contacts with two separate recoil channels in the rail body weapon accessory mounting surface. In addition, the use of two or more floating side rail clamp weapon accessory mount adaptor crossbars and/or posts helps minimize, and/or eliminate, rotational movement.

In addition, as noted above, in one embodiment, the floating side rail clamp weapon accessory mount adaptor disclosed herein requires no adjustment, and/or adjustment tools, in the field.

Consequently, a weapon accessory mounting system employing the floating side rail clamp weapon accessory mount adaptor disclosed herein provides weapons users, including soldiers and law enforcement officers in the field, with a weapon accessory mounting system that is easy to use, even in the field and/or under fire, is highly reliable, and has significant tolerance for dimensional variation and combat damage. Therefore, the floating side rail clamp weapon accessory mount adaptor disclosed herein provides weapons accessory capability that is extremely versatile and combat effective.

In addition, as discussed in more detail below, using the below embodiments, with little or no modification and/or user input, there is considerable flexibility, adaptability, and opportunity for customization to meet the specific needs of various user's under numerous circumstances.

BRIEF DESCRIPTION OF THE DRAWINGS

FIGS. 6M to 6O show a two dimensional plan view of floating side rail clamp weapon accessory mount adaptor including a cam being rotated into an "on center" fully locked condition;

FIG. 6P shows two views of one embodiment of a leaf spring engagement means of the floating side rail clamp weapon accessory mount adaptor of FIG. 6A that, in accordance with one embodiment, includes a cam system;

DETAILED DESCRIPTION

Embodiments will now be discussed with reference to the accompanying FIG.s, which depict one or more exemplary embodiments. Embodiments may be embodied in many different forms and should not be construed as limited to the embodiments set forth herein, shown in the FIG.s, and/or described below. Rather, these exemplary embodiments are provided to allow a complete disclosure that conveys the principles of the invention, as set forth in the claims, to those of skill in the art.

In accordance with one embodiment, a floating side rail clamp weapon accessory mount adaptor includes a stationary side rail clamp, a movable floating side rail clamp, and a leaf spring system operatively coupled to the floating side rail clamp on a second side of the floating side rail clamp. In one embodiment, the floating side rail clamp moves as a single unit under evenly increasing force provided by the leaf spring system, the force being applied by the leaf spring system to the movable floating side rail clamp under the influence of the leaf spring system. In one embodiment, the floating side rail clamp moves as a single unit such that a floating side rail clamp engagement surface of the floating side rail clamp remains substantially parallel to a corresponding portion of a stationary side rail clamp engagement surface of the stationary side rail clamp as the floating side rail clamp moves, as a unit, towards the stationary side rail clamp in a direction substantially perpendicular to the stationary side rail clamp engagement surface.

Figure 6A:
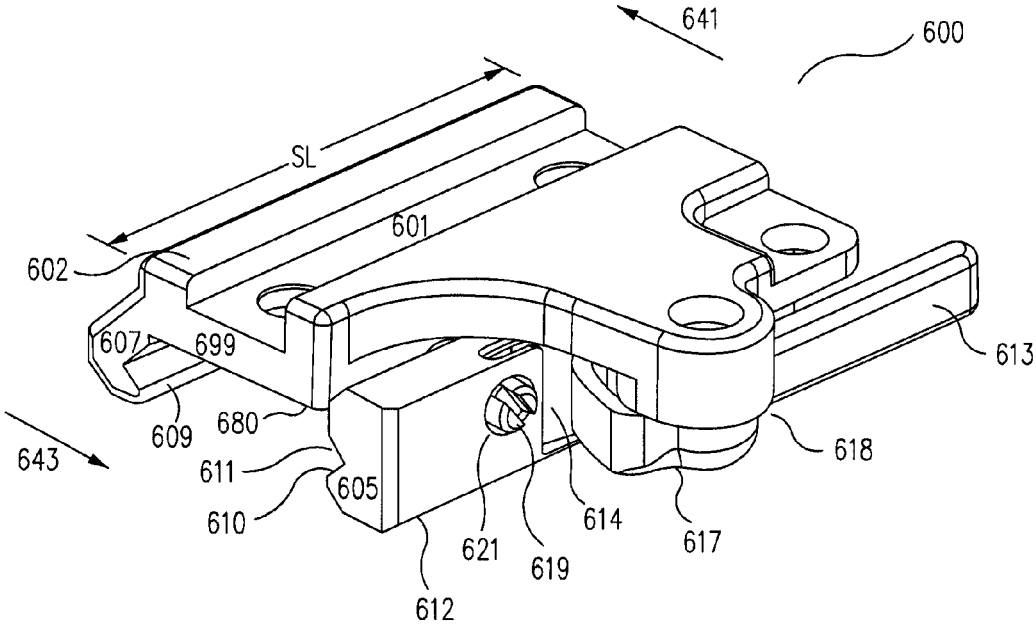
FIG. 6A shows a right front isometric view of a floating side rail clamp weapon accessory mount adaptor in accordance with one embodiment.

FIG. 6A shows a right front isometric view of a floating side rail clamp weapon accessory mount adaptor 600 in accordance with one embodiment. As seen in FIG. 6A, floating side rail clamp weapon accessory mount adaptor 600 includes floating side rail clamp weapon accessory mount adaptor body 601. In one embodiment, floating side rail clamp weapon accessory mount adaptor body 601 includes a stationary side rail clamp 607 formed on, or attached to, a floating side rail clamp weapon accessory mount adaptor body first side 602.

Figure 1:
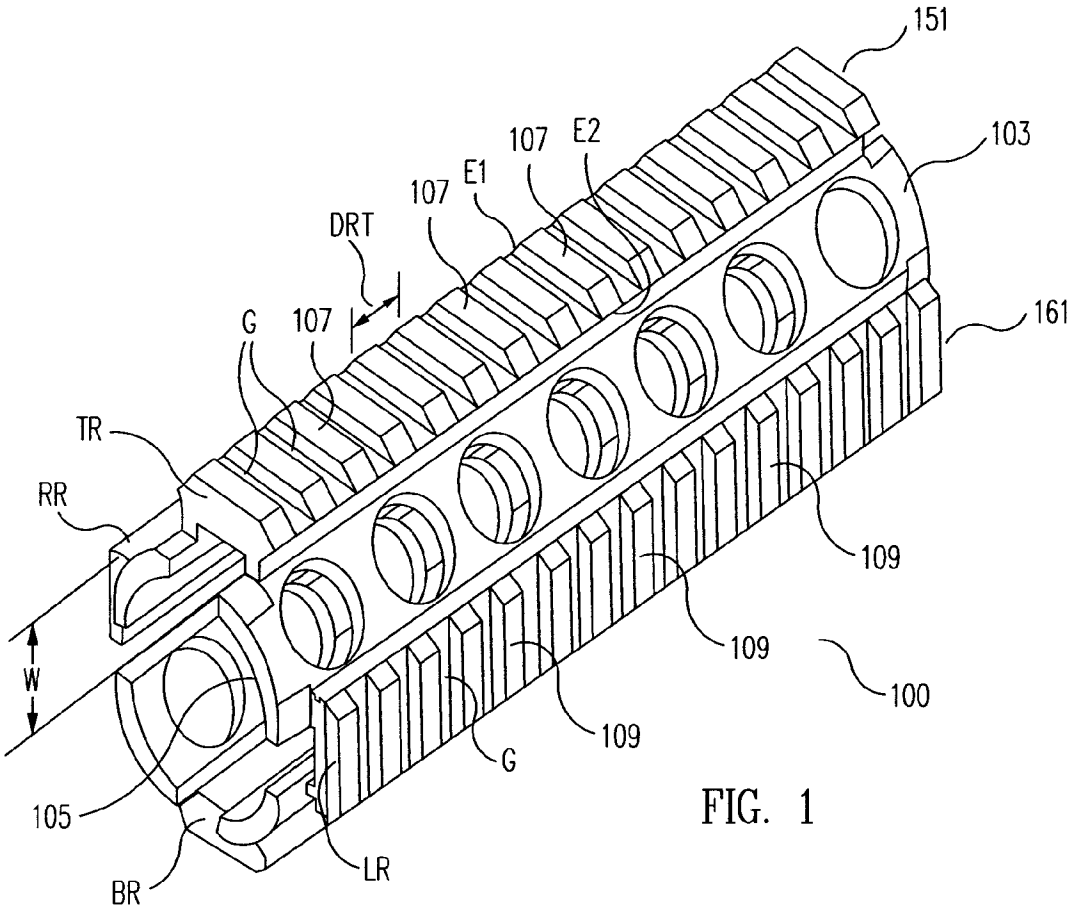
FIG. 1 is a three-dimensional view of a conventional weapon accessory mounting system rail body to which a floating side rail clamp weapon accessory mount adaptor can be attached in accordance with one embodiment.
Figure 2:
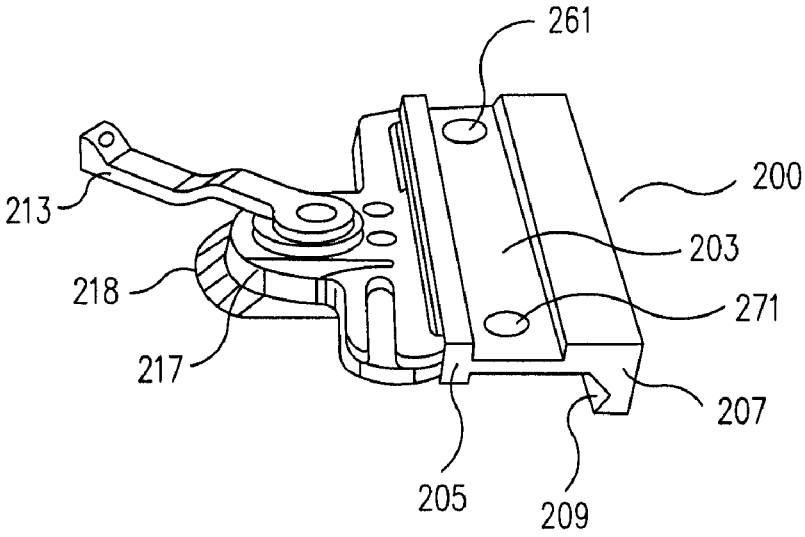
FIG. 2 (PRIOR ART)
FIG. 2 is a three-dimensional top view of a prior art weapon accessory mount adaptor.
Figure 3:
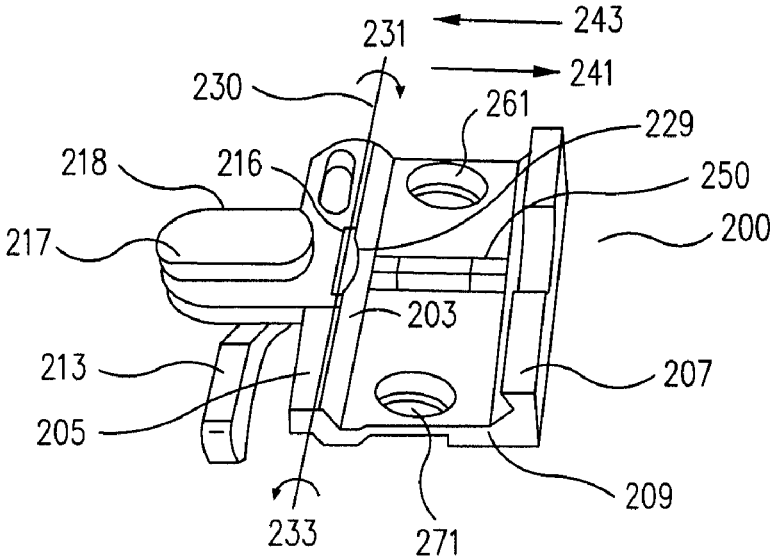
FIG. 3 (PRIOR ART)
FIG. 3 is a three-dimensional bottom view of the prior art weapon accessory mount adaptor illustrated in FIG. 2.
Figure 4:
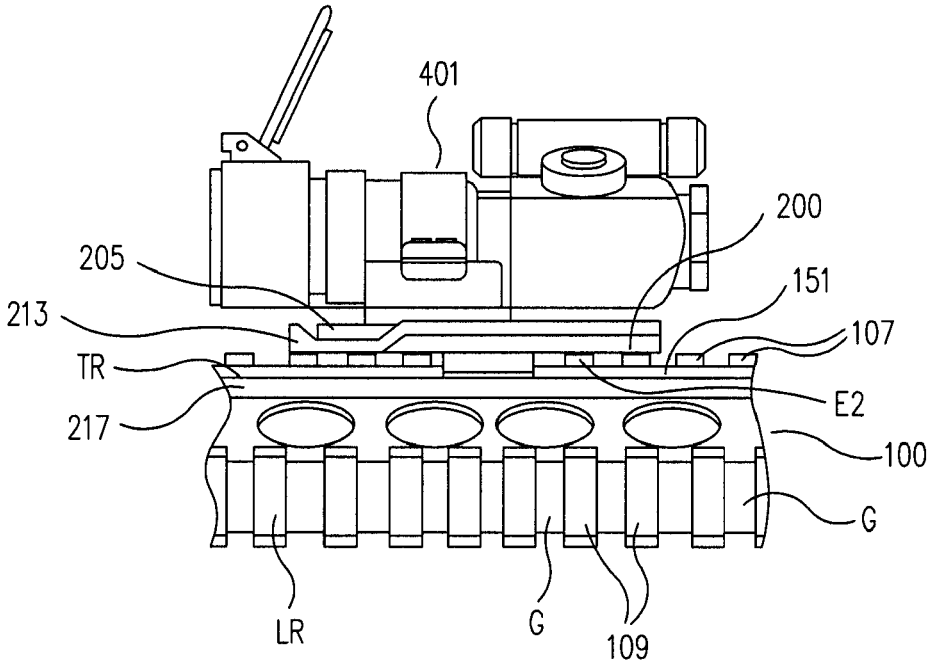
FIG. 4 (PRIOR ART)
FIG. 4 is a side plan view of the prior art weapon accessory mount adaptor according to FIG. 2 having a weapon accessory mounted thereon and shown attached to the weapon accessory mounting system rail body illustrated in FIG. 1.
Figure 4A:
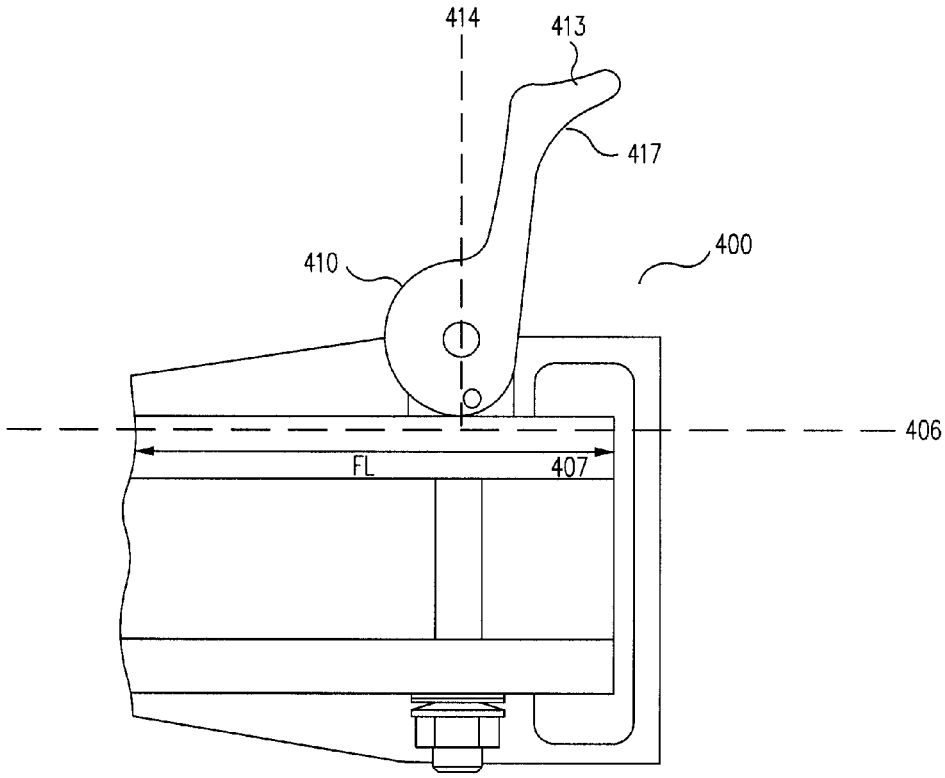
FIG. 4A (PRIOR ART)
FIGS. 4A to 4C show a two dimensional plan view of a prior art weapon accessory mount adaptor including a generic exemplary cam being rotated into an "over center position" fully locked condition.
Figure 4B:
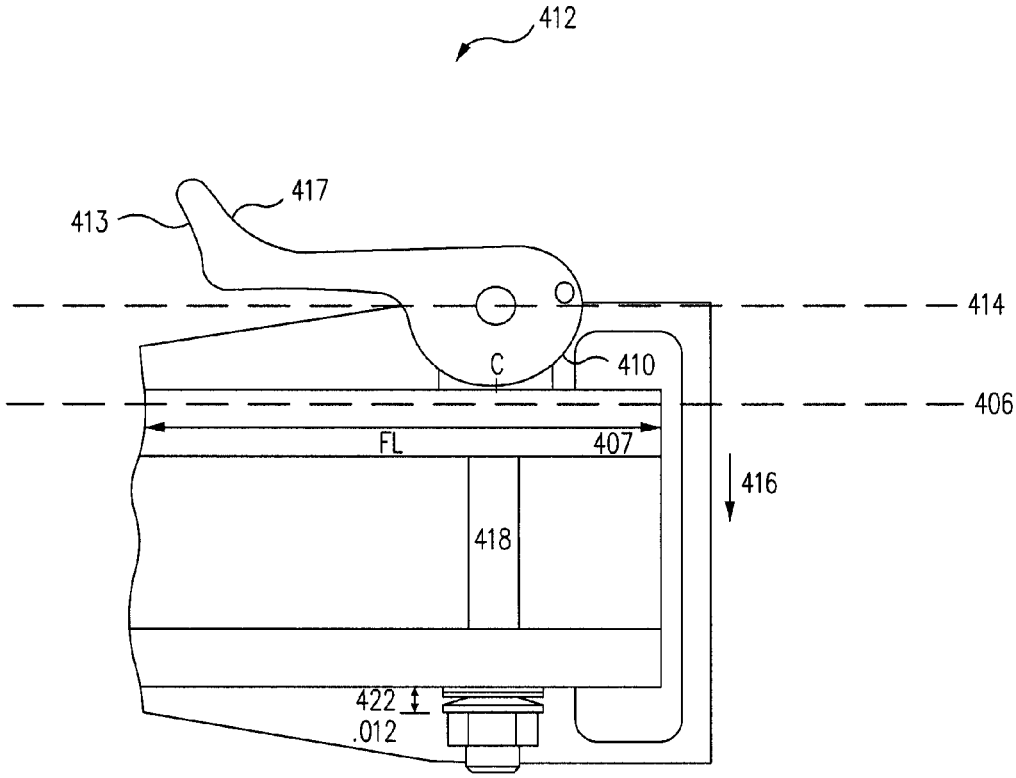
FIG. 4B (PRIOR ART)
Figure 4C:
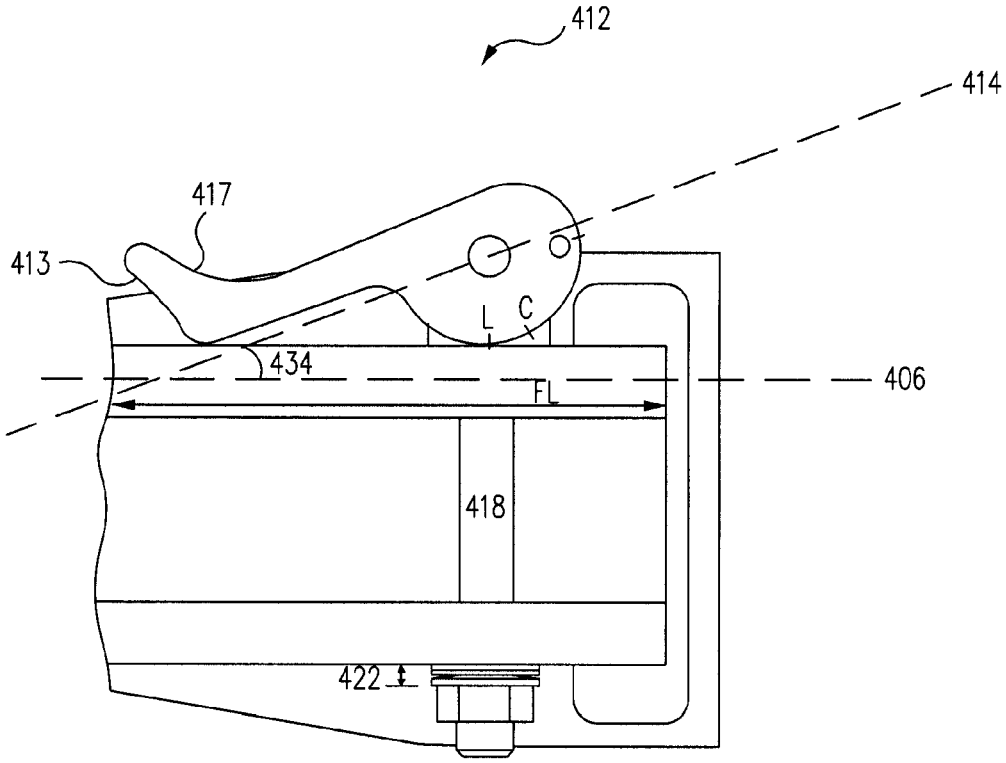
FIG. 4C (PRIOR ART)

In one embodiment, stationary side rail clamp 607 includes stationary side rail clamp engagement surface 609 that runs along at least a portion of the length "SL" of stationary side rail clamp 607, and that, in one embodiment, is used to engage a portion of a first edge of the desired rail body of a weapon accessory mounting system, such as edge E1 of top rail weapon accessory mounting surface 151 of FIG. 1 discussed above.

Returning to FIG. 6A, in one embodiment, floating side rail clamp weapon accessory mount adaptor 600 includes a floating side rail clamp 605 movably retained with respect to floating side rail clamp weapon accessory mount adaptor body 601 on a floating side rail clamp weapon accessory mount adaptor body second side 680 that is opposite to floating side rail clamp weapon accessory mount adaptor body first side 602.

In one embodiment, floating side rail clamp 605 includes a floating side rail clamp engagement surface 610 that runs along at least a portion of the length of floating side rail clamp first surface 611. In one embodiment, floating side rail clamp 605 includes a floating side rail clamp second surface 612 that is opposite floating side rail clamp first surface 611 and floating side rail clamp engagement surface 610.

Figure 6B:
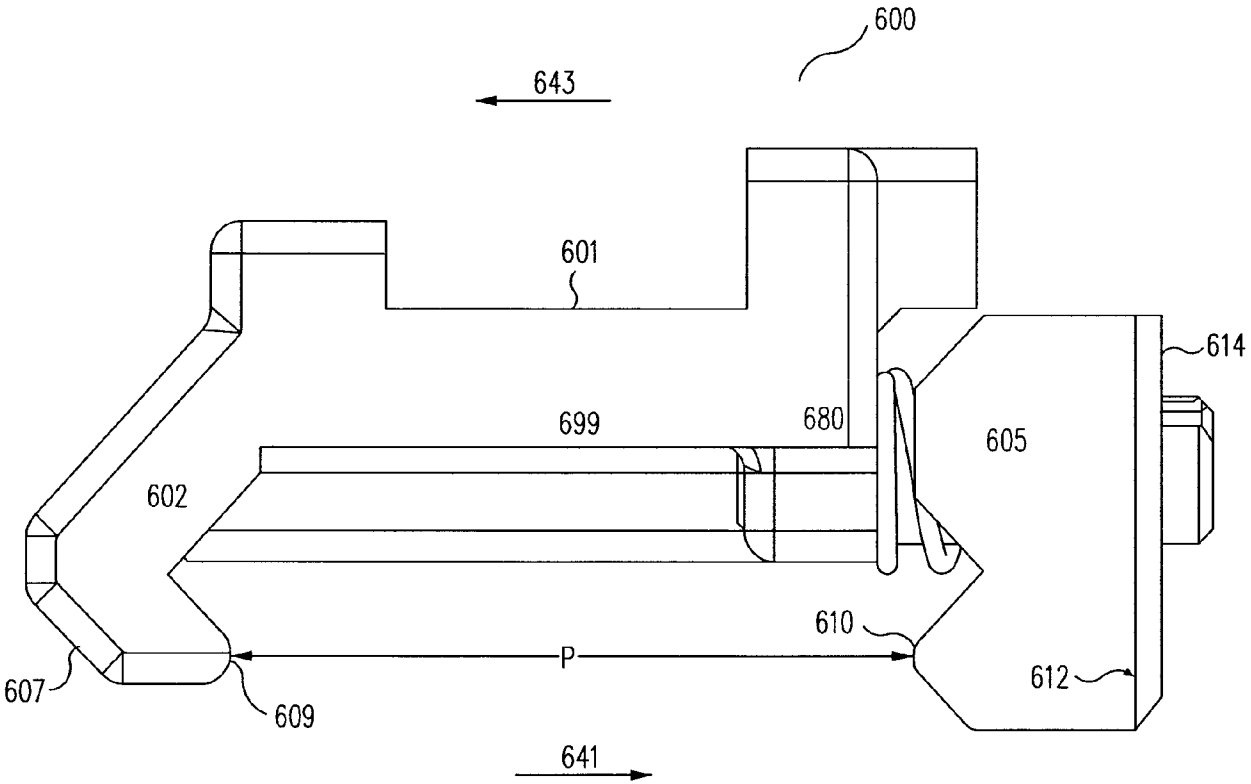
FIG. 6B shows a planar front view of one end of the floating side rail clamp weapon accessory mount adaptor of FIG. 6A.

In one embodiment, floating side rail clamp 605 is capable of moving, as a unit, in directions 641 and 643, thereby increasing or decreasing, respectively, distance "P" between floating side rail clamp engagement surface 610 and stationary side rail clamp engagement surface 609 (see FIG. 6B).

As discussed in more detail below, in embodiment, floating side rail clamp 605 is movably retained with respect to floating side rail clamp weapon accessory mount adaptor body 601 by two or more floating side rail clamp weapon accessory mount adaptor posts, such as floating side rail clamp weapon accessory mount adaptor post 619 shown in FIG. 6A and FIG. 6C, extending through adaptor post holes formed through the floating side rail clamp (641 and 643 in FIG. 6D). In one embodiment, a first end of the two or more floating side rail clamp weapon accessory mount adaptor posts, such as first end 621 of floating side rail clamp weapon accessory mount adaptor post 619 extend through adaptor post holes (Not shown in FIG. 6A, see FIGS. 641 and 643 in FIG. 6D) formed through floating side rail clamp 605 to floating side rail clamp second surface 612 that is opposite floating side rail clamp first surface 611 and floating side rail clamp engagement surface 610 of floating side rail clamp 605.

In one embodiment, floating side rail clamp weapon accessory mount adaptor 600 includes a floating side rail leaf spring system, in this embodiment including one or more leaf springs 614 (see FIG. 6C as well) and a cam system 618, including cam quick release lever 613 and attached cam 617.

In one embodiment, floating side rail clamp 605 moves as a single unit under evenly increasing influence provided by leaf spring 614, cam quick release lever 613, and attached cam 617 with a cam leaf spring engagement surface discussed below. In one embodiment, floating side rail clamp 605 moves as a single unit such that floating side rail clamp engagement surface 610 of floating side rail clamp 605 remains substantially parallel to stationary side rail clamp engagement surface 609 of stationary side rail clamp 607 as floating side rail clamp 605 moves, as a unit, towards stationary side rail clamp 607 in direction 641 substantially perpendicular to stationary side rail clamp engagement surface 609.

FIG. 6B shows a front view of end 699 of the floating side rail clamp weapon accessory mount adaptor 600 of FIG. 6A in accordance with one embodiment. Shown in FIG. 6B is floating side rail clamp weapon accessory mount adaptor 600 including floating side rail clamp weapon accessory mount adaptor body 601. As noted above, in one embodiment, floating side rail clamp weapon accessory mount adaptor body 601 includes a stationary side rail clamp 607 formed on, or attached to, a floating side rail clamp weapon accessory mount adaptor body first side 602.

As shown in FIG. 6B, stationary side rail clamp 607 includes stationary side rail clamp engagement surface 609 that runs along at least a portion of the length "SL" of stationary side rail clamp 607 (SL not shown in FIG. 6B, see FIG. 6C), and that, in one embodiment, is used to engage a portion of a first edge of the desired rail body of a weapon accessory mounting system, such as edge E1 of top rail weapon accessory mounting surface 151 of FIG. 1 discussed above.

Also shown in FIG. 6B is floating side rail clamp 605 movably retained with respect to floating side rail clamp weapon accessory mount adaptor body 601 on a floating side rail clamp weapon accessory mount adaptor body second side 680 that is opposite to floating side rail clamp weapon accessory mount adaptor body first side 602.

Also shown in FIG. 6B is floating side rail clamp engagement surface 610 that runs along at least a portion of the length of floating side rail clamp first surface 611. Also shown in FIG. 6B is floating side rail clamp second surface 612 that, in one embodiment, is opposite floating side rail clamp first surface 611 and floating side rail clamp engagement surface 610.

As noted above, in one embodiment, floating side rail clamp 605 is capable of moving, as a unit, in directions 641 and 643, thereby increasing or decreasing, respectively, distance "P" between floating side rail clamp engagement surface 610 and a corresponding portion of stationary side rail clamp engagement surface 609.

Figure 6C:
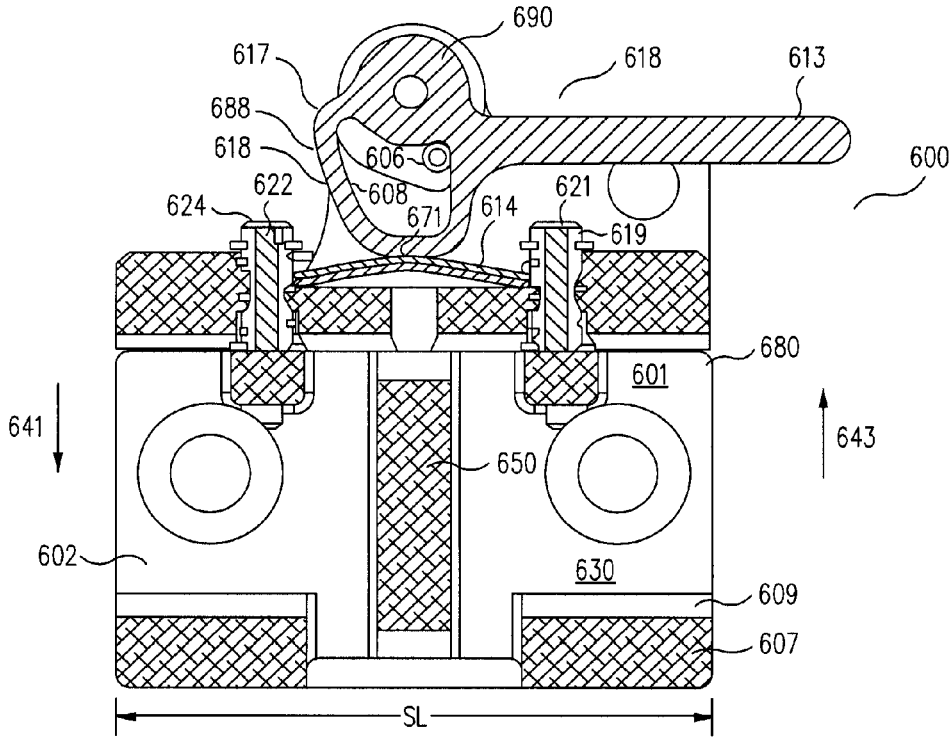
FIG. 6C shows a planar view of an underside surface of the floating side rail clamp weapon accessory mount adaptor of FIG. 6A in accordance with one embodiment.

As noted above, in one embodiment, floating side rail clamp 605 moves as a single unit under evenly increasing influence provided by leaf spring 614 and cam system 618 (See FIG. 6C). In one embodiment, floating side rail clamp 605 moves as a single unit such that floating side rail clamp engagement surface 610 of floating side rail clamp 605 remains substantially parallel to stationary side rail clamp engagement surface 609 of stationary side rail clamp 607 as floating side rail clamp 605 moves, as a unit, towards stationary side rail clamp 607 in direction 641 substantially perpendicular to stationary side rail clamp engagement surface 609.

FIG. 6C shows a planar cutaway view of underside surface 630 (see FIGS. 6B and 6C) of the floating side rail clamp weapon accessory mount adaptor 600 of FIG. 6A in accordance with one embodiment. Shown in FIG. 6C is floating side rail clamp weapon accessory mount adaptor 600 including floating side rail clamp weapon accessory mount adaptor body 601. Also Shown in FIG. 6C is stationary side rail clamp 607 formed on, or attached to, floating side rail clamp weapon accessory mount adaptor body first side 602.

As also shown in FIG. 6C, in one embodiment, stationary side rail clamp 607 includes stationary side rail clamp engagement surface 609 that runs along at least a portion of the length "SL" of stationary side rail clamp 607, and that, in one embodiment, is used to engage a portion of a first edge of the desired rail body of a weapon accessory mounting system, such as edge E1 of top rail weapon accessory mounting surface 151 of FIG. 1 discussed above.

As also shown in FIG. 6C, in one embodiment, floating side rail clamp weapon accessory mount adaptor 600 includes a floating side rail leaf spring system, in this embodiment, including leaf spring 614, and cam system 618 including cam quick release lever 613 and attached cam 617 and cam leaf spring engagement surface 688.

Also shown in FIG. 6C are floating side rail clamp weapon accessory mount adaptor posts 619 and 622, and floating side rail clamp weapon accessory mount adaptor post first ends 621 and 624 of floating side rail clamp weapon accessory mount adaptor posts 619 and 622.

In one embodiment, floating side rail clamp weapon accessory mount adaptor posts 619 and 622 are designed to be positioned between two consecutive rail weapon accessory mounting surface crossbars in a respective recoil channel, such as in a respective recoil channel "G" of top rail weapon accessory mounting surface crossbars 107 of top rail (TR) of weapon accessory mounting system rail body 100 in FIG. 1.

Returning to FIG. 6C, the use of two or more floating side rail clamp weapon accessory mount adaptor posts 619 and 622, helps minimize, and/or eliminate, the piston action associated with prior art weapon accessory mount adaptor, discussed above, by providing at least two separate floating side rail clamp weapon accessory mount adaptor crossbar contacts with two separate recoil channels in the rail body weapon accessory mounting surface. In addition, the use of two or more floating side rail clamp weapon accessory mount adaptor posts 619 and 622, helps minimize, and/or eliminate, rotational movement of floating side rail clamp weapon accessory mount, adaptor 600.

In embodiment, floating side rail clamp 605 (See FIG. 6B) is movably retained with respect to floating side rail clamp weapon accessory mount adaptor body 601 by floating side rail clamp weapon accessory mount adaptor posts 619 and 622 extending through adaptor post holes formed through the floating side rail clamp (not shown in FIG. 6C, see FIGS. 6D, 6M, 6N and 6O). In one embodiment floating side rail clamp weapon accessory mount adaptor post first ends 621 and 624 of floating side rail clamp weapon accessory mount adaptor posts 619 and 622 extend through the adaptor post holes (not shown in FIG. 6C, see FIGS. 6D, and 6H) formed through floating side rail clamp 605 to floating side rail clamp second surface 612 and floating side rail clamp engagement surface 610 of floating side rail clamp 605.

In one embodiment, floating side rail clamp weapon accessory mount adaptor posts 619 and 622 extend lengthwise perpendicular to floating rail clamp engagement surface 610 of floating side rail clamp 605 and perpendicular to stationary side rail clamp engagement surface 609 of stationary side rail clamp 607.

In one embodiment, floating side rail clamp weapon accessory mount adaptor posts 619 and 622 extend through the adaptor post holes formed through the floating side rail clamp (not shown in FIG. 6C, see FIG. 6D) to floating side rail clamp weapon accessory mount adaptor post attachment positions 631 and 633 (not shown in FIG. 6C, see FIG. 6F) formed in or on floating side rail clamp weapon accessory mount adaptor body 601. In one embodiment, floating side rail clamp weapon accessory mount adaptor post attachment positions 631 and 633 (not shown in FIG. 6C, see FIG. 6F) are threadably coupled to respective floating side rail clamp weapon accessory mount adaptor post second ends 653 and 655 (not shown in FIG. 6C, see FIG. 6D) of floating side rail clamp weapon accessory mount adaptor posts 619 and 622, opposite floating side rail clamp weapon accessory mount adaptor post first ends 621 and 624 of floating side rail clamp weapon accessory mount adaptor posts 619 and 622.

In one embodiment, floating side rail clamp weapon accessory mount adaptor post second ends 653 and 655 (not shown in FIG. 6C, see FIG. 6D) of floating side rail clamp weapon accessory mount adaptor posts 619 and 622 are coupled to 631 and 633 (not shown in FIG. 6C, see FIG. 6F) that correspond to floating side rail clamp weapon accessory mount adaptor crossbars 650 and 651 formed in floating side rail clamp weapon accessory mount adaptor body 601.

Returning to FIG. 6B and FIG. 6C, as noted above, floating side rail clamp 605 moves as a single unit under evenly increasing influence provided by leaf spring 614 and cam system 618 including cam quick release lever 613 and attached cam 617, cam leaf spring engagement surface 688, and cam stop 606. In one embodiment, floating side rail clamp 605 moves as a single unit such that floating side rail clamp engagement surface 610 of floating side rail clamp 605 remains substantially parallel to a corresponding portion of stationary side rail clamp engagement surface 609 of stationary side rail clamp 607 as floating side rail clamp 605 moves, as a unit, towards stationary side rail clamp 607 in direction 641 substantially perpendicular to stationary side rail clamp engagement surface 609 along floating side rail clamp weapon accessory mount adaptor posts 619 and 622.

Referring now to FIGS. 6A to 6P further details of the structure and operation of floating side rail clamp weapon accessory mount adaptor 600 will now be discussed.

Figure 6D:
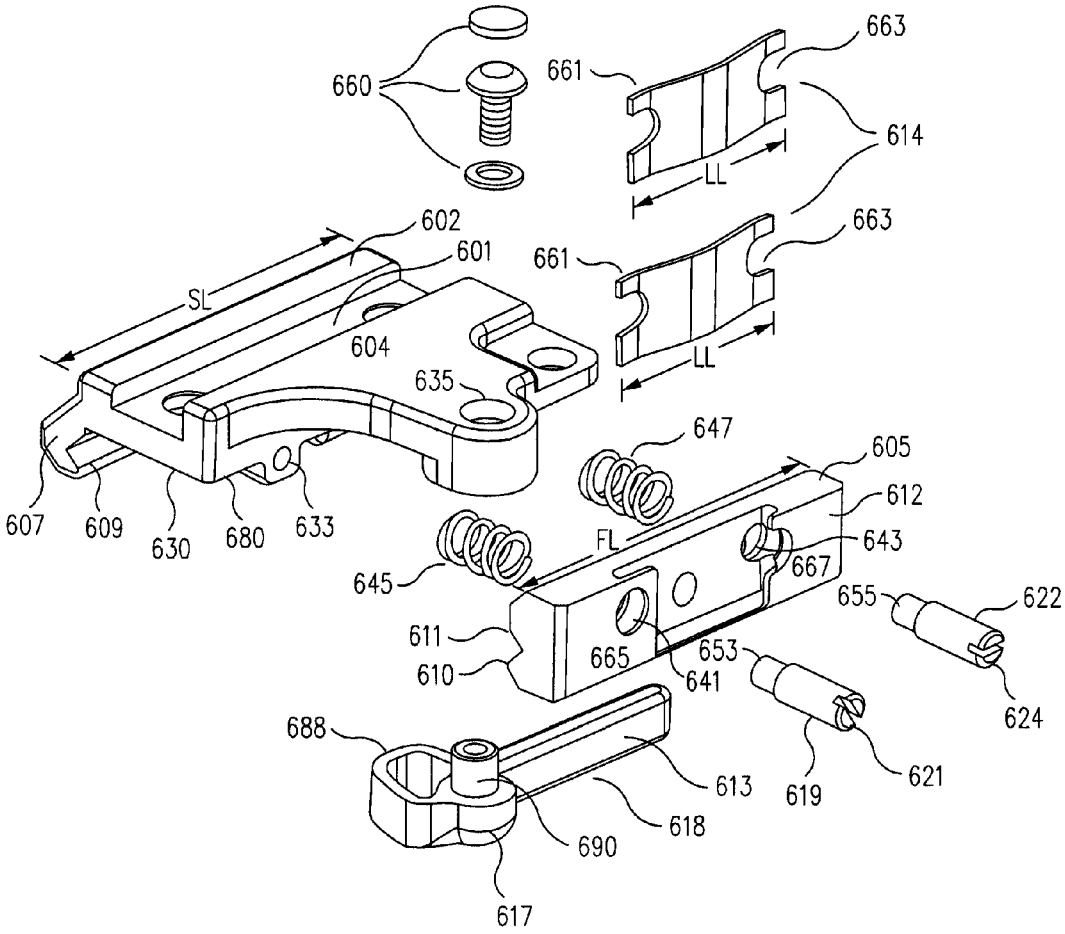
FIG. 6D shows an exploded left front top isometric view of the floating side rail clamp weapon accessory mount adaptor of FIG. 6A in accordance with one embodiment.

FIG. 6D shows an exploded left front top isometric view of floating side rail clamp weapon accessory mount adaptor 600 of FIG. 6A in accordance with one embodiment.

FIG. 6D shows floating side rail clamp weapon accessory mount adaptor body 601 including: floating side rail clamp weapon accessory mount adaptor body top surface 604; floating side rail clamp weapon accessory mount adaptor bottom surface 630; floating side rail clamp weapon accessory mount adaptor body first side 602; floating side rail clamp weapon accessory mount adaptor body second side 680; stationary side rail clamp 607 formed on, or attached to, a floating side rail clamp weapon accessory mount adaptor body first side 602; stationary side rail clamp engagement surface 609 that runs along at least a portion of the length "SL" of stationary side rail clamp 607; floating side rail clamp weapon accessory mount adaptor post attachment position 633; and cam shaft retaining hole 635.

FIG. 6D also shows floating side rail clamp weapon accessory mount adaptor posts 619 and 622 having floating side rail clamp weapon accessory mount adaptor post fist ends 621 and 624, respectively, and floating side rail clamp weapon accessory mount adaptor post second ends 653 and 655.

FIG. 6D also shows floating side rail clamp 605 that includes: floating side rail clamp engagement surface 610 that runs along at least a portion of the length "FL" of floating side rail clamp first surface 611; floating side rail clamp second surface 612 that is opposite floating side rail clamp first surface 611 and floating side rail clamp engagement surface 610; and floating side rail clamp weapon accessory mount adaptor post holes 641 and 643 formed through floating side rail clamp 605 and through which floating side rail clamp weapon accessory mount adaptor posts 619 and 622 extend.

FIG. 6D also shows one or more leaf springs 614 each have a first leaf spring end 661 and a second leaf spring end 663, opposite first leaf spring end 661, along a length "LL" of leaf spring 614. FIG. 6D also shows return springs 645 and 647. FIG. 6D also shows cam system 618 including cam quick release lever 613 with attached cam 617 and cam leaf spring engagement surface 688 of cam 617 that forms a curved outside edge surface of cam 617.

In one embodiment, bottom surface 630 of floating side rail clamp weapon accessory mount adaptor 600 is attached to at least a portion of a rail body weapon accessory mounting surface, such top rail weapon accessory mounting surface 151, of a weapon accessory mounting system rail body, such as weapon accessory mounting system rail body 100 of FIG. 1. In one embodiment, the rail body weapon accessory mounting surface is a Picatinny rail or Weaver rail system. In other embodiments, the rail body weapon accessory mounting surface is any rail body weapon accessory mounting surface of any weapon accessory mounting system rail body, as discussed herein, and/or known in the art at the time of filing, and/or as developed after the time of filing.

In one embodiment, top surface 604 of floating side rail clamp weapon accessory mount adaptor 600 is also attached to a weapons accessory, such as, but not limited to: visible and non-visible spectrum LASER pointing devices; visible and non-visible spectrum LASER target illumination/identification devices; visible and non-visible spectrum LASER range finding systems; visible and non-visible spectrum illumination systems; mechanical or "iron" sighting systems; magnified and/or non-magnified optical sights and/or quick target acquisition devices; visible and/or non-visible spectrum user identification devices; maintenance and/or weapons status tracking devices; user/unit identification and/or position identification/monitoring devices; communication and/or command and control devices; and/or any one or more of the numerous other weapons accessories as discussed herein, and/or known in the art at the time of filing, and/or as developed after the time of filing.

In one embodiment, top surface 604 of floating side rail clamp weapon accessory mount adaptor 600 is removably attached to weapon accessory. In other instances, top surface 604 of floating side rail clamp weapon accessory mount adaptor 600 is formed as an integral part of a weapon accessory. In addition, in some instances, floating side rail clamp weapon accessory mount adaptor 600, and/or the weapon accessory itself include a weapon accessory mounting surface (not shown) capable of providing an attachment point for a second floating side rail clamp weapon accessory mount adaptor.

Figure 6E:
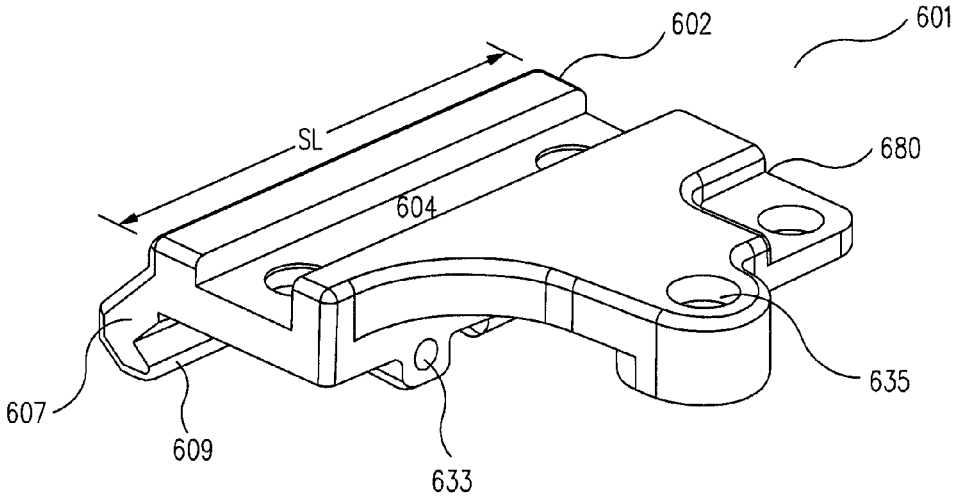
FIG. 6E shows a left front top isometric view of a floating side rail clamp weapon accessory mount adaptor body of the floating side rail clamp weapon accessory mount adaptor of FIG. 6A in accordance with one embodiment.
Figure 6F:
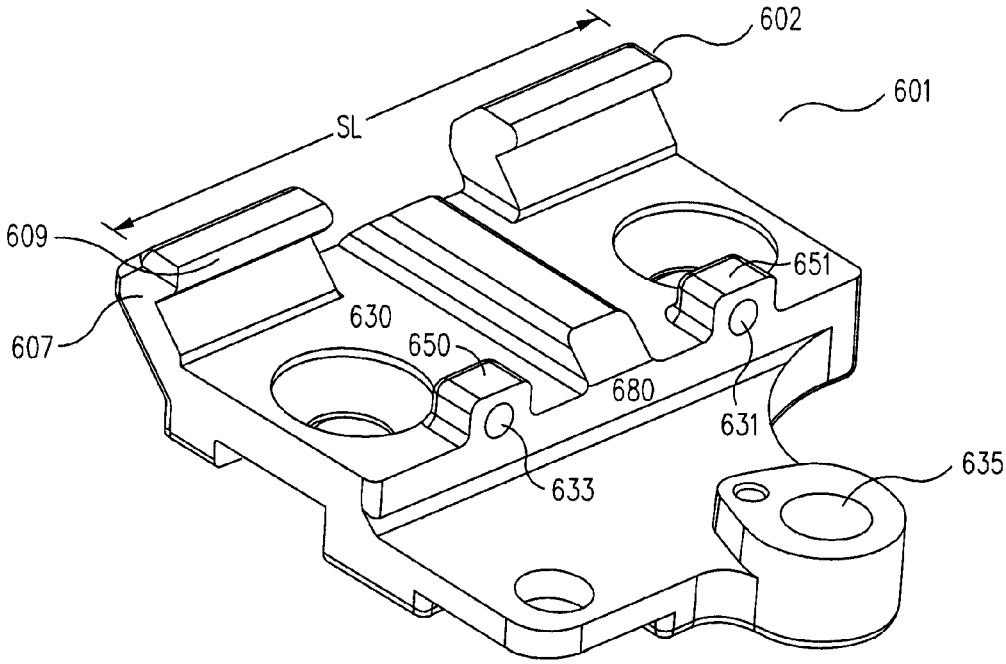
FIG. 6F shows a left front bottom isometric view of a floating side rail clamp weapon accessory mount adaptor body of the floating side rail clamp weapon accessory mount adaptor of FIG. 6A in accordance with one embodiment.

Returning to FIG. 6D, as noted above, in one embodiment, floating side rail clamp weapon accessory mount adaptor 600 includes floating side rail clamp weapon accessory mount adaptor body 601. FIG. 6E shows a left front top isometric view of floating side rail clamp weapon accessory mount adaptor body 601. FIG. 6F shows a left front bottom isometric view of floating side rail clamp weapon accessory mount adaptor body 601.

As seen in FIGS. 6E and 6F, floating side rail clamp weapon accessory mount adaptor body 601 includes stationary side rail clamp 607 formed on, or attached to, a floating side rail clamp weapon accessory mount adaptor body first side 602.

As seen in FIGS. 6E and 6F, stationary side rail clamp 607 includes stationary side rail clamp engagement surface 609 that runs along at least a portion of the length "SL" of stationary side rail clamp 607, and that, in one embodiment, is used to engage a portion of a first edge of the desired rail body of a weapon accessory mounting system, such as edge E1 of top rail weapon accessory mounting surface 151 of FIG. 1 discussed above. In one embodiment, stationary side rail clamp engagement surface 609 is a stationary side rail clamp groove formed by a beveled edge designed to engage a first edge of a rail body weapon accessory mounting surface, such as edge E1 of top rail weapon accessory mounting surface 151 of FIG. 1.

As also seen in FIG. 6F, floating side rail clamp weapon accessory mount adaptor body 601 includes floating side rail clamp weapon accessory mount adaptor crossbar 650. In one embodiment, floating side rail clamp weapon accessory mount adaptor crossbar 650 is designed to be positioned between two consecutive rail weapon accessory mounting surface crossbars in a respective recoil channel, such as in a respective recoil channel "G" of top rail weapon accessory mounting surface crossbars 107 of top rail (TR) of weapon accessory mounting system rail body 100 in FIG. 1.

Returning to FIG. 6F, in some embodiments, not shown the use of two or more floating side rail clamp weapon accessory mount adaptor crossbars, such as floating side rail clamp weapon accessory mount adaptor crossbar 650, helps minimize, and/or eliminate, the piston action associated with prior art weapon accessory mount adaptor, discussed above, by providing at least two separate floating side rail clamp weapon accessory mount adaptor crossbar contacts with two separate recoil channels in the rail body weapon accessory mounting surface.

As also seen in FIGS. 6E and 6F, floating side rail clamp weapon accessory mount adaptor body 601 includes floating side rail clamp weapon accessory mount adaptor post attachment positions 631 and 633 formed in floating side rail clamp weapon accessory mount adaptor body second side 680.

Referring to FIGS. 6D, 6E, and 6F, in one embodiment, floating side rail clamp weapon accessory mount adaptor post attachment positions 631 and 633 (FIG. 6F) are threadably coupled to respective second ends 653 and 655 (FIG. 6D) of floating side rail clamp weapon accessory mount adaptor posts 619 and 622, opposite floating side rail clamp weapon accessory mount adaptor post first ends 621 and 624 of floating side rail clamp weapon accessory mount adaptor posts 619 and 622.

In one embodiment, second ends 653 and 655 of floating side rail clamp weapon accessory mount adaptor posts 619 and 622 and are coupled to floating side rail clamp weapon accessory mount adaptor post attachment positions 631 and 633 (FIG. 6F) formed in floating side rail clamp weapon accessory mount adaptor body 601.

As also seen in FIGS. 6E and 6F, floating side rail clamp weapon accessory mount adaptor body 601 includes, in one embodiment, cam shaft retaining hole 635 used to retain cam shaft 690 attached to cam quick release lever 613 and cam 617 (FIG. 6D and FIG. 6P).

Figure 6G:
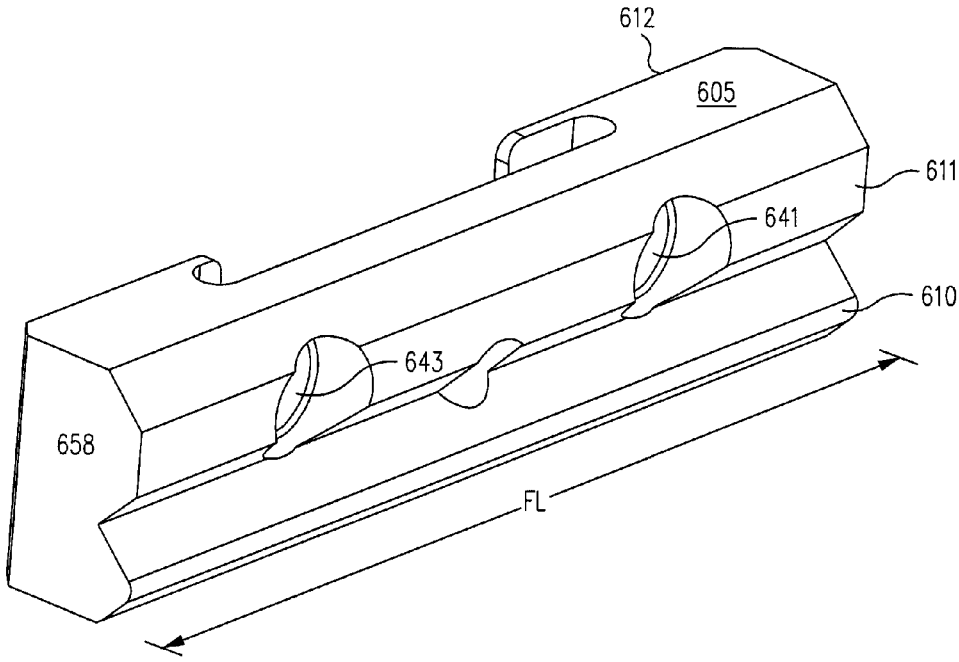
FIGS. 6G to 6H show exemplary details of a floating side rail clamp of the floating side rail clamp weapon accessory mount adaptor of FIG. 6A in accordance with one embodiment.
Figure 6H:
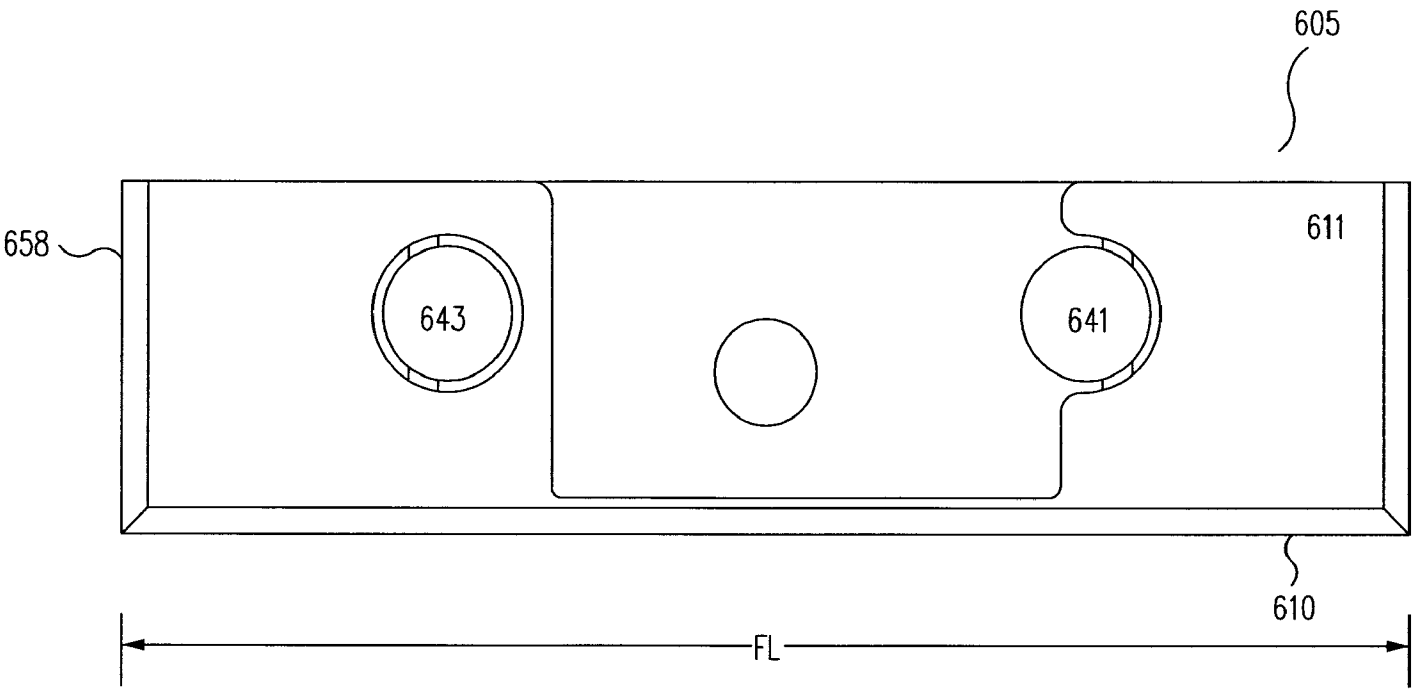

Returning to FIG. 6D, in one embodiment, floating side rail clamp weapon accessory mount adaptor 600 includes floating side rail clamp 605. FIGS. 6G to 6H show details of floating side rail clamp 605. As seen in FIGS. 6G to 6H, floating side rail clamp 605 includes floating side rail clamp engagement surface 610 that runs along at least a portion of the length "FL" of floating side rail clamp first surface 611. As also seen in FIGS. 6G to 6H, floating side rail clamp 605 includes floating side rail clamp second surface 612 that is opposite floating side rail clamp first surface 611 and floating side rail clamp engagement surface 610. As also seen in FIGS. 6G to 6H, floating side rail clamp 605 includes floating side rail clamp weapon accessory mount adaptor post holes 641 and 643 formed through floating side rail clamp 605 and through which floating side rail clamp weapon accessory mount adaptor posts 619 and 622 (FIG. 6D) extend.

FIG. 6H shows a planar view of floating side rail clamp first surface 611 of FIG. 6G.

Referring to FIGS. 6G to 6H and FIG. 6D, as discussed in more detail below, in one embodiment, floating side rail clamp second surface 612 is coupled to, and subject to leaf spring engagement force from, a leaf spring assembly discussed below including one or more leaf springs 614 and cam system 618.

In one embodiment, floating side rail clamp engagement surface 610 of floating side rail clamp first surface 611 is a floating side rail clamp groove formed by a beveled edge designed to engage in one embodiment, a portion of a first edge of the desired rail body of a weapon accessory mounting system, such as edge E2 of top rail weapon accessory mounting surface 151 of FIG. 1 discussed above.

Referring now to FIGS. 6G to 6H, FIG. 6B, and FIG. 6C, in embodiment, floating side rail clamp 605 is movably retained with respect to floating side rail clamp weapon accessory mount adaptor 600 body such that floating side rail clamp 605 can move along an axis perpendicular to stationary side rail clamp engagement surface 609 of the stationary side rail clamp 607 (FIG. 6C). In embodiment, floating side rail clamp 605 is movably retained with respect to floating side rail clamp weapon accessory mount adaptor body 601 such that floating side rail clamp 605 can move along the axis perpendicular to stationary side rail clamp engagement surface 609 of stationary side rail clamp 607 such that the entire floating side rail clamp engagement surface 610 of floating side rail clamp 605 remains substantially parallel to stationary side rail clamp engagement surface 609 of stationary side rail clamp 607 while moving along the axis perpendicular to stationary side rail clamp engagement surface 609 of stationary side rail clamp 607.

Referring now to FIG. 6G, FIG. 6C, FIG. 6D, and FIGS. 6M to 6O, in embodiment, floating side rail clamp 605 is movably retained with respect to floating side rail clamp weapon accessory mount adaptor body 601 by floating side rail clamp weapon accessory mount adaptor posts 619 and 622 (FIG. 6D) extending through floating side rail clamp weapon accessory mount adaptor post holes 641 and 643 (FIG. 6D and FIG. 6H) formed through floating side rail clamp 605 (FIG. 6D and FIG. 6G). In one embodiment first ends 621 and 624 of floating side rail clamp weapon accessory mount adaptor posts 619 and 622 extend through floating side rail clamp weapon accessory mount adaptor post holes 641 and 643 (FIG. 6D) to floating side rail clamp second surface 612 (FIG. 6G) that is opposite floating side rail clamp first surface 611 and floating side rail clamp engagement surface 610 of the floating side rail clamp 605.

In one embodiment, floating side rail clamp weapon accessory mount adaptor posts 619 and 622 extend lengthwise perpendicular to stationary side rail clamp engagement surface 609 of stationary side rail clamp 607 (see FIG. 6C).

In one embodiment, floating side rail clamp weapon accessory mount adaptor posts 619 and 622 extend through adaptor post holes 641 and 643 (FIG. 6D) to floating side rail clamp weapon accessory mount adaptor post attachment positions 633 and 631 (FIG. 6F) in floating side rail clamp weapon accessory mount adaptor body 601.

In one embodiment, floating side rail clamp weapon accessory mount adaptor post attachment positions 633 and 631 (FIG. 6F) are threadably coupled to second ends 653 and 655 of floating side rail clamp weapon accessory mount adaptor posts 619 and 622, opposite first ends 621 and 629 of floating side rail clamp weapon accessory mount adaptor posts 619 and 622 (FIG. 6D).

Returning to FIG. 6D, as noted above, in one embodiment, floating side rail clamp weapon accessory mount adaptor 600 includes a floating side rail clamp weapon accessory mount adaptor leaf spring system. In one embodiment, floating side rail clamp weapon accessory mount adaptor leaf spring system includes one or more leaf springs 614 and a leaf spring engagement means, such as cam system 618.

Figure 6J:
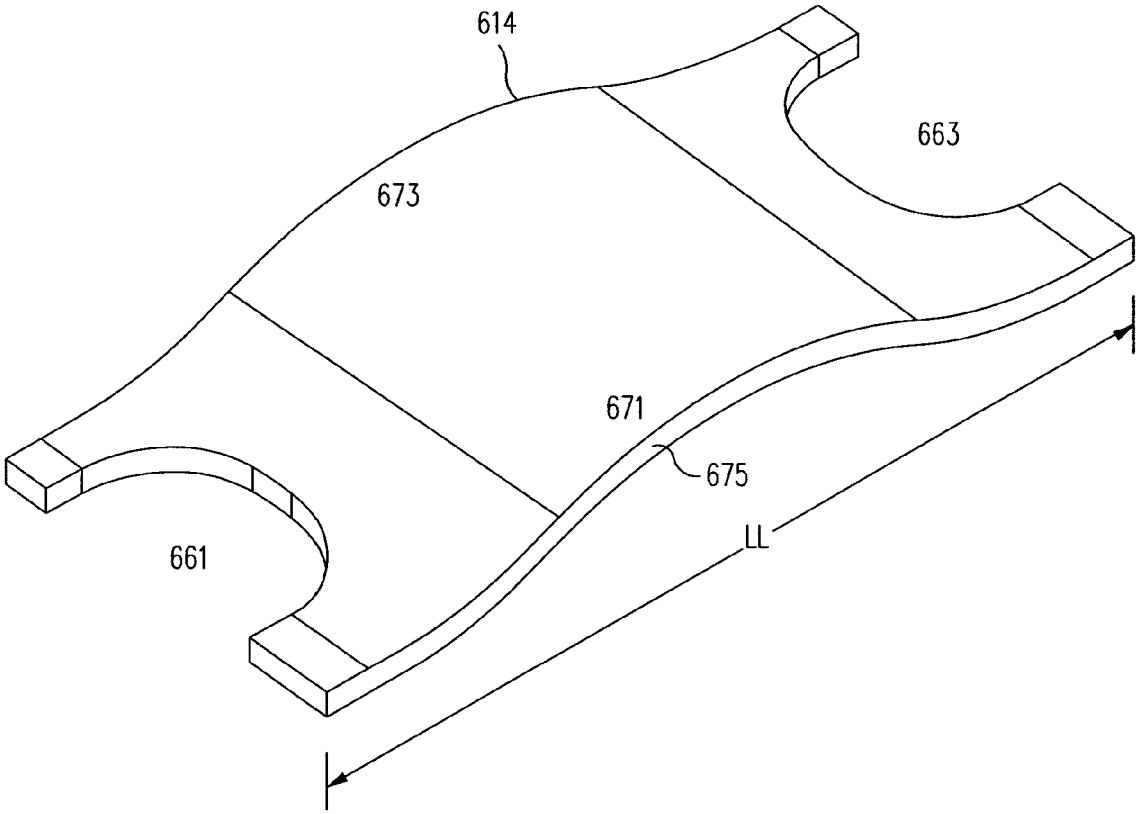
FIGS. 6J to 6L show exemplary details of an exemplary leaf spring of the floating side rail clamp weapon accessory mount adaptor of FIG. 6A in accordance with one embodiment.
Figure 6K:
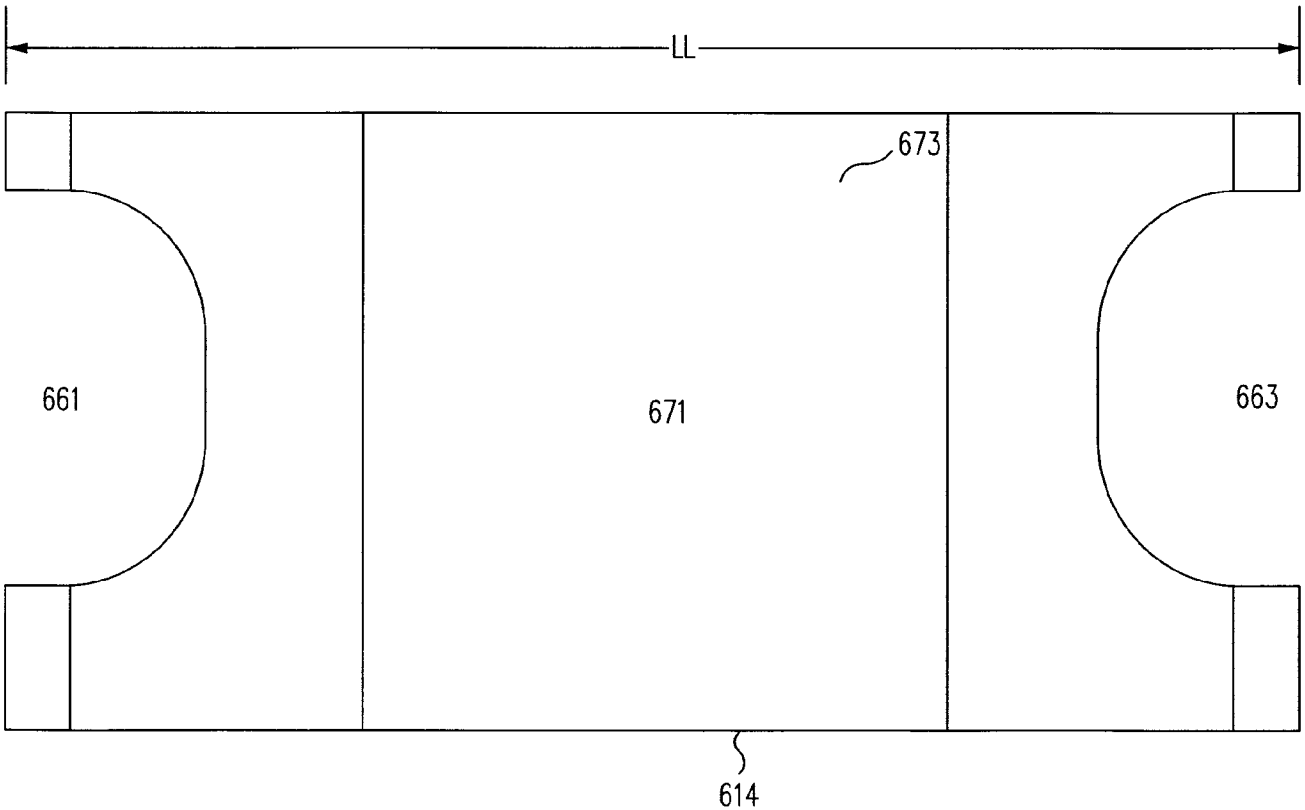
Figure 6L:
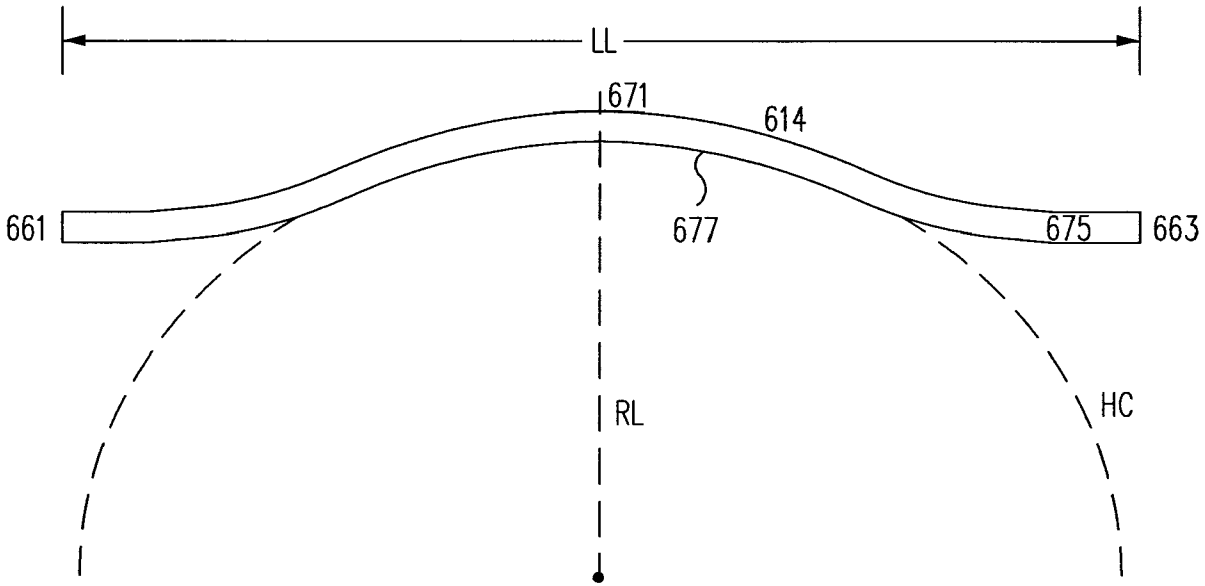

FIGS. 6J to 6L show details of an exemplary leaf spring 614 in accordance with one embodiment. Referring now to FIG. 6D and FIGS. 6J to 6L, in one embodiment, the one or more leaf springs 614 each have a first leaf spring end 661 and a second leaf spring end 663, opposite first leaf spring end 661, along a relaxed state length "LL" of leaf spring 614. In one embodiment, first leaf spring end 661 of leaf spring 614 is positioned in operative contact with first leaf spring contact point 665 on floating side rail clamp second surface 612 (see FIG. 6D). In one embodiment, second leaf spring end 663 of leaf spring 614 is positioned in operative contact with a second leaf spring contact point 667 on floating side rail clamp second surface 612 (see FIG. 6D) that is opposite first second leaf spring contact point 661 along length "FL" of second surface of the floating side rail clamp 612 (see FIGS. 6D and 6G).

In one embodiment, first leaf spring end 661 of leaf spring 614 and second leaf spring end 663 of leaf spring 614 are attached to first leaf spring contact point 665 and second leaf spring contact point 667, respectively, and secured by floating side rail clamp weapon accessory mount adaptor post first ends 621 and 624 of floating side rail clamp weapon accessory mount adaptor posts 619 and 622 that extend through floating side rail clamp weapon accessory mount adaptor post holes 641 and 643 formed through floating side rail clamp 605 and through which floating side rail clamp weapon accessory mount adaptor posts 619 and 622 extend (FIG. 6D and FIG. 6C).

In one embodiment, first leaf spring end 661 of leaf spring 614 and second leaf spring end 663 of leaf spring 614 are in operative contact with first leaf spring contact point 665 and second leaf spring contact point 667, respectively, on the floating side rail clamp second surface 612 such that when leaf spring 614 is subjected to an engagement pressure, and is thereby engaged, a leaf spring engagement force is exerted on floating side rail clamp second surface 612 in direction 641 (FIG. 6A and FIG. 6C), and in a relatively even manner along the entire length "FL" of floating side rail clamp second surface 612.

In one embodiment, the leaf spring engagement force along the entire length "FL" of floating side rail clamp second surface 612 causes the entire floating side rail clamp 605 to move, as a unit, in direction 641 substantially perpendicular to stationary side rail clamp engagement surface 609 along the floating side rail clamp weapon accessory mount adaptor posts 619 and 622 such that floating side rail clamp engagement surface 610 of floating side rail clamp 605 remains substantially parallel to stationary side rail clamp engagement surface 609 of stationary side rail clamp 607.

In one embodiment, the leaf spring engagement means, includes a leaf spring leaf spring engagement surface, such as cam leaf spring engagement surface 688 of FIG. 6P, that physically engages a leaf spring engagement portion 671 of leaf spring 614 (FIGS. 6J to 6L) and thereby provides the engagement pressure required to engage leaf spring 614. As discussed below, leaf spring engagement portion 671 of leaf spring 614 engages when leaf spring engagement means is in a an "on center" locked position. As discussed in more detail below, in various embodiments, the leaf spring engagement means is manually activated by the user taking an action such as turning a knob or by engaging a quick release lever, or other, clamp.

FIG. 6K shows a planar view of a top surface 673 of leaf spring 614.

Figure 6M:
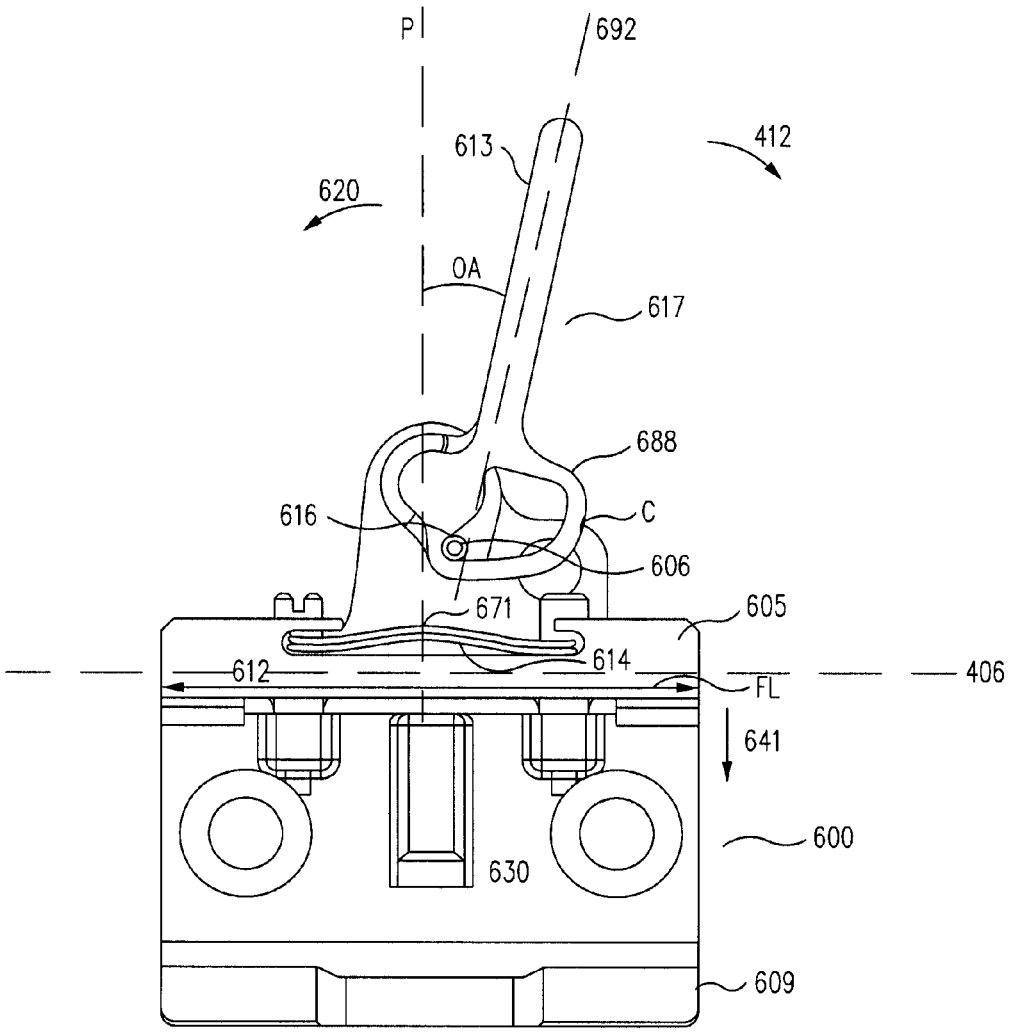

FIG. 6L shows a planar view of a side 675 of leaf spring 614. In addition, FIG. 6M shows radius of curvature RL of leaf spring 614 that is the radius of a hypothetical circle HC that would include curved portion 677 of leaf spring 614. Radius RL of leaf spring 614 is the radius associated with the curved portion 677 of leaf spring 614.

Referring back to FIGS. 6A and 6D, in one embodiment, the leaf spring engagement means is cam system 618 including cam quick release lever 613 attached to a cam 617. FIG. 6P shows two views of one embodiment of a cam system 618. As seen in FIG. 6P, cam system 618 includes cam quick release lever 613 and attached cam 617. As also seen in FIG. 6P, cam system 618 includes cam system first surface 683 and cam system second surface 685. As also seen in FIG. 6P, cam system 618 includes cam leaf spring engagement surface 688, forming an outside edge of cam 617, and cam shaft 690, including cam rotation axis 691. As also seen in FIG. 6P, cam leaf spring engagement surface 688 includes center surface "C" that, as discussed below, engages and makes contact with leaf spring engagement portion 671 of leaf spring 614 when cam 617 is in a an "on center" locked position.

Figure 6N:
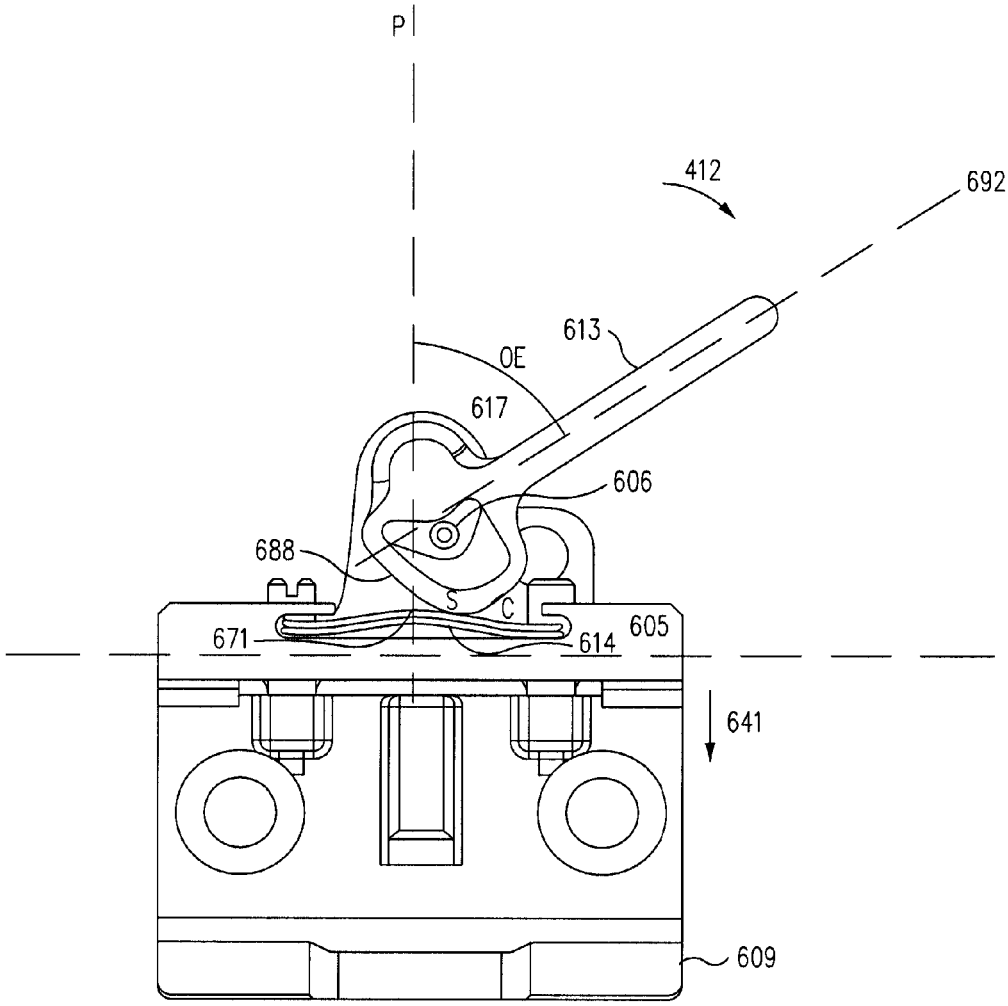
Figure 60:
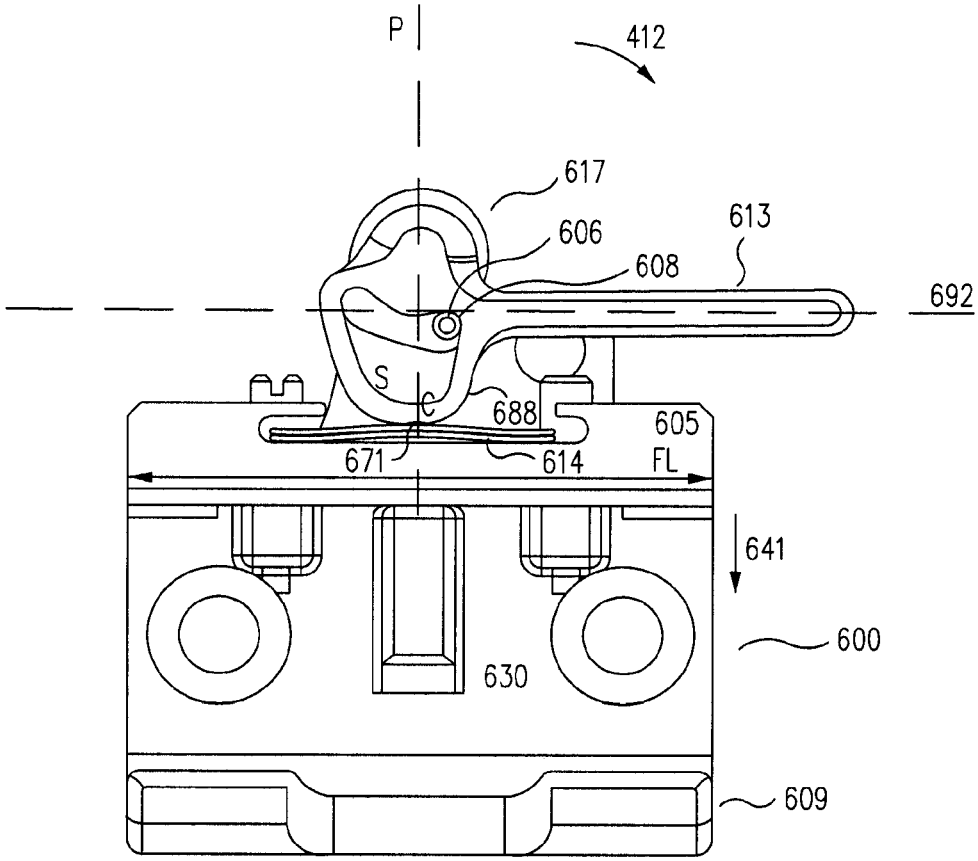
Figure 6Q:
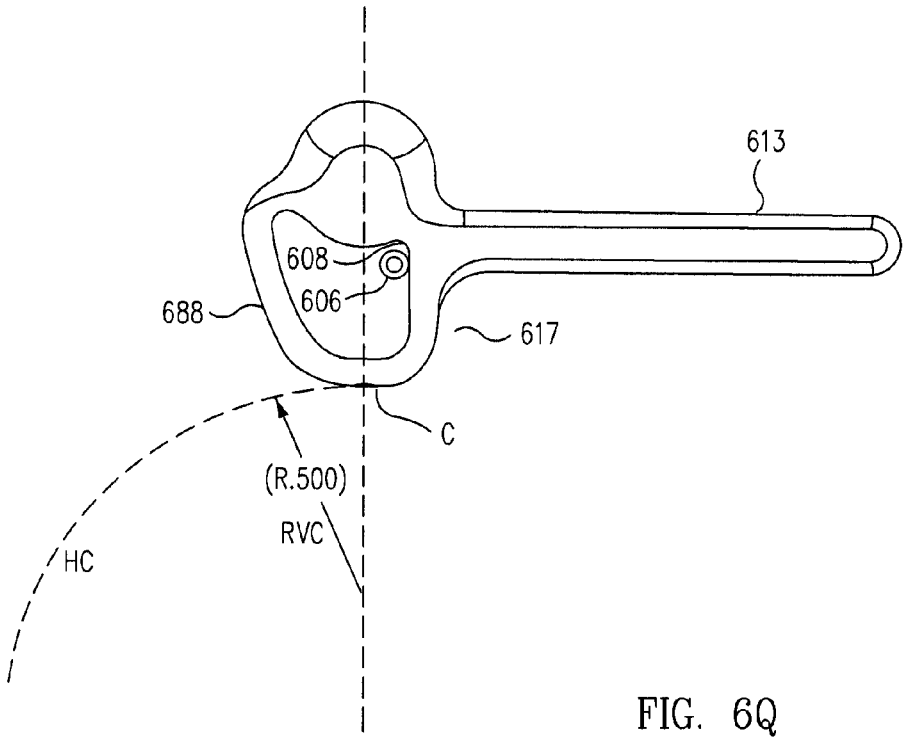
FIG. 6Q shows exemplary details of an exemplary cam of the cam system of FIG. 6P.

FIG. 6Q shows details of cam 617 including curved cam leaf spring engagement surface 688 and cam stop 606. As discussed above with respect to FIGS. 6M, 6N and 6O, in one embodiment, when the floating side rail clamp weapon accessory mount adaptor is in the "fully locked" position, a portion of inner surface 608 of cam 617 makes contact with cam stop 606 such that cam 617 is prevented from rotating past the "center position", where cam lever 613 extends along cam lever axis more or less parallel to a length of the floating side-rail as opposed to the "over center" position typically used in the prior art.

As noted above, in one embodiment, cam leaf spring engagement surface 688 forms a curved outside edge surface of cam 617 and includes a center curved surface "C" that engages and makes contact with leaf spring engagement portion 671 of leaf spring 614 when cam 617 is in a an "on center" locked position and thereby provides the engagement pressure to the one or more leaf springs when cam 617 is in the centered and locked position. In one embodiment, center surface "C" is itself curved with a curvature radius RVC. In one embodiment, center surface "C" is itself curved with a curvature radius RVC that is the radius of a hypothetical circle HC that would include curved portions 677 of leaf spring 614 (FIG. 6L). That is to say, in one embodiment, center surface "C" is itself curved with a curvature radius RVC to match the curvature RL (See FIG. 6L) of the one or more leaf springs in the locked position. Consequently, in this embodiment, the two surfaces have matching curvature radiuses that naturally lock together when engaged.

Figure 6R:
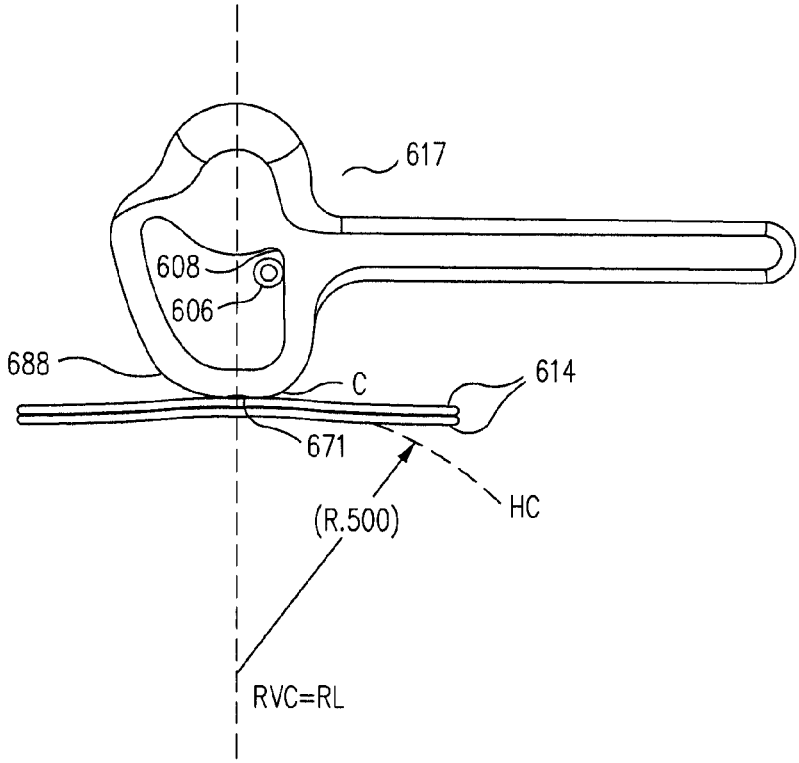
FIG. 6R shows an exemplary cam of the cam system of FIG. 6P engaging an exemplary leaf spring system of the floating side rail clamp weapon accessory mount adaptor of FIG. 6A Common reference numerals are used throughout the FIG.s and the detailed description to indicate like elements. One skilled in the art will readily recognize that the above FIG.s are examples and that other architectures, modes of operation, orders of operation and elements/functions can be provided and implemented without departing from the characteristics and features of the invention, as set forth in the claims.

In addition, as noted above, when cam 617 is in the "center position", a portion of inner surface 608 of cam 617 makes contact with cam stop 606 such that cam 617 is and is prevented from rotating past the "center position" when locked. Consequently, the prior art need for an over center locked position is eliminated FIG. 6R shows one embodiment of cam 617 including cam leaf spring engagement surface 688 and center curved surface "C" that engages and makes contact with leaf spring engagement portion 671 of leaf springs 614 when cam 617 is in a an "on center" locked position and thereby provides the engagement pressure to leaf springs 614 when cam 617 is in the centered and locked position. As shown in FIG. 6R. in one embodiment, center surface "C" is itself curved with a curvature radius RVC of a hypothetical circle HC is equal to the curvature radius RL of leaf springs 614 in the locked position. As noted, above, since, in this embodiment, the two surfaces, i.e., center surface "C" of cam leaf spring engagement surface 688 and leaf spring engagement portion 671 of leaf springs 614 have matching curvature radii, the two surfaces naturally lock together when engaged.

Referring now to FIGS. 6A, 6D, 6M, 6N, 6O, and 6P, 6Q, and 6R when the user engages cam quick release lever 613 with increasing pressure, cam quick release lever 613 causes cam 617 to rotate and gradually increase a variable cam radius, such as, RV1, RV2, RV3 and RVC in FIG. 6Q, extending from cam rotation axis 691 of cam shaft 690 to various locations on cam leaf spring engagement surface 688 that contact leaf spring engagement portion 671 thereby gradually, smoothly, and evenly, increasing the engagement pressure applied to leaf spring 614 via leaf spring engagement portion 671. This smoothly increasing engagement pressure thereby causes leaf spring 614 to exert a leaf spring engagement force on floating side rail clamp second surface 612 in direction 641 (FIG. 6A and FIG. 6N), and in a relatively even distributed and smooth manner along the entire length "FL" of floating side rail clamp second surface 612.

In one embodiment, the variable cam radii, such as RV1, RV2, RV3, and RVC of cam 617, are specially designed to gradually increase through fractions of the relaxed leaf spring curvature radius RL (FIG. 6L) that exists when leaf spring 614 is under no engagement pressure.

As also noted above, in one embodiment, cam leaf spring engagement surface 688 forms a curved outside edge surface of cam 617 and includes a center surface "C" that, engages and makes contact with leaf spring engagement portion 671 of leaf spring 614 when cam 617 is in a an "on center" locked position and thereby provides the engagement pressure to the one or more leaf springs when cam 617 is in the centered and locked position. In one embodiment, center surface "C" is itself curved with a curvature radius RVC. In one embodiment, center surface "C" is itself curved with a curvature radius RVC that is the radius of a hypothetical circle HC that would include curved portions 677 of leaf spring 614 (FIG. 6L).

FIGS. 6M to 6O show a two dimensional plan view of floating side rail clamp weapon accessory mount adaptor 600 including cam 617 being rotated into an "on center" fully locked condition.

As seen in FIG. 6M, initially cam 617 is in the "open" position such cam lever axis 692 is at a relatively small angle OA with respect to line "P" that is a line perpendicular to line 406 that runs parallel to a length FL of a floating side-rail 605. Also shown in FIG. 6M is cam stop 606. As seen in FIG. 6M, when cam 617 is in the "open" position a portion of inner surface 616 of cam 617 makes contact with cam stop 606 such that cam 617 is prevented from rotating beyond the "open" position in a direction 620.

FIG. 6N shows cam 617 after having been rotated in direction 412 by cam lever 613 to a start engagement position and point "S" of contact surface 688 of cam 617 is in contact with leaf spring engagement portion 671 of leaf spring 614. is at a relatively small angle OA with respect to line "P" that is a line perpendicular to line 406 that runs parallel to a length FL of a floating side-rail 605.

As shown in FIG. 6N, the rotation of cam 617 results in cam lever axis 692 being at a relatively larger angle OE with respect to line "P" that is a line perpendicular to line 406 that runs parallel to a length FL of a floating side-rail 605.

In this specific illustrative example, the rotation of cam lever 613 and cam 617 to the start engagement position exerts an engagement pressure on leaf spring 614 and leaf spring 614, in turn, exerts a leaf spring force that causes floating side-rail 605 to move in a direction 641 towards fixed side rail 609. It is worth noting that leaf spring 614 is in contact with floating side rail 605 and exerts its force directly on floating side rail 605.

FIG. 6O shows cam 617 after having been rotated in direction 412 by cam lever 613 to the "on center" and locked position such that cam lever axis 692 is more or less perpendicular with respect to line "P" that is a line perpendicular to line 406 that runs parallel to a length FL of a floating side-rail 605, and therefore cam lever axis 692 is more or less parallel to length FL of a floating side-rail 605, and center point "C" of contact surface 688 of cam 617 is in contact with leaf spring engagement portion 671 of leaf spring 614. In addition, as noted above, when cam 617 is in the "center position", a portion of inner surface 608 of cam 617 makes contact with cam stop 606 such that cam 617 is and is prevented from rotating past the "center position" when locked.

As noted above, in one embodiment, cam leaf spring engagement surface 688 forms a curved outside edge surface of cam 617 and includes a center surface "C" that, engages and makes contact with leaf spring engagement portion 671 of leaf spring 614 when cam 617 is in a an "on center" locked position and thereby provides the engagement pressure to the one or more leaf springs when cam 617 is in the centered and locked position. In one embodiment, center surface "C" is itself curved with a curvature radius RVC. In one embodiment, center surface "C" is itself curved with a curvature radius RVC that is the radius of a hypothetical circle HC that would include curved portions 677 of leaf spring 614 (FIG. 6L). That is to say, in one embodiment, center surface "C" is itself curved with a curvature radius RVC to match the curvature RL of the one or more leaf springs in the locked position. Consequently, in this embodiment, the two surfaces have matching curvature radiuses that naturally lock together when engaged (See FIG. 6R). Consequently, the prior art need for an over center locked position is eliminated.

Returning to FIG. 6D, in one embodiment, floating side rail clamp weapon accessory mount adaptor 600 includes return springs 645 and 647 used to apply a returning, or "opening" force on floating side rail clamp in a direction 641 (FIG. 6A) opposite to direction 643 of the leaf spring engagement force.

In one embodiment, return springs 645 and 647 are coupled to, or fitted around, second ends 653 and 655 of floating side rail clamp weapon accessory mount adaptor posts 619 and 622 between floating side rail clamp first surface 611 and floating side rail clamp weapon accessory mount adaptor post attachment positions 633 and 631 (FIG. 6F) on floating side rail clamp weapon accessory mount adaptor body second side 680 (FIG. 6D). Return springs 645 and 647 thereby apply a returning, or "opening" force on floating side rail clamp 605 in a direction opposite to the leaf spring engagement force applied along the entire length of floating side rail clamp second surface 612.

In one embodiment, the returning force provided by return springs 645 and 647 serves to further ensure that the leaf spring engagement force is applied evenly, and in a gradual and evenly increasing manner, along the entire length of floating side rail clamp second surface 612 and that entire floating side rail clamp 605 moves as a unit in direction 643 (FIG. 6A) that is substantially perpendicular to stationary side rail clamp engagement surface 609, along floating side rail clamp weapon accessory mount adaptor posts 619 and 622, such that floating side rail clamp engagement surface 610 of floating side rail clamp 605 remains substantially parallel to stationary side rail clamp engagement surface 609 of the stationary side rail clamp 607.

In addition, in one embodiment, the returning force provided by return springs 645 and 647 serves to return floating side rail clamp to the fully open position as a default position whenever the leaf spring engagement force is released via user manipulation of the leaf spring engagement means, such as cam system 618, and hold floating side rail clamp weapon accessory mount adaptor 600 in the open position having a maximum perpendicular distance "P" (FIG. 6C) between floating side rail clamp engagement surface 610 of floating side rail clamp 605 and the corresponding portion of stationary side rail clamp engagement surface 609 of stationary side rail clamp 607. This makes it easier to re-attach floating side rail clamp weapon accessory mount adaptor 600 to a rail body weapon accessory mounting surfaces when needed.

The floating side rail clamp weapon accessory mount adaptor, as disclosed herein, includes a stationary side rail and a second side rail that itself is a floating side rail clamp movably retained with respect to the floating side rail clamp weapon accessory mount adaptor body and directly coupled to a biasing leaf spring force. Consequently, according to the floating side rail clamp weapon accessory mount adaptor as disclosed herein, the entire floating side rail clamp can move along an axis perpendicular to the stationary side rail clamp engagement surface of the stationary side rail clamp. This construction means that the floating side rail clamp weapon accessory mount adaptor, as disclosed herein, has several advantages over prior art weapon accessory mount adaptors.

Figure 5:
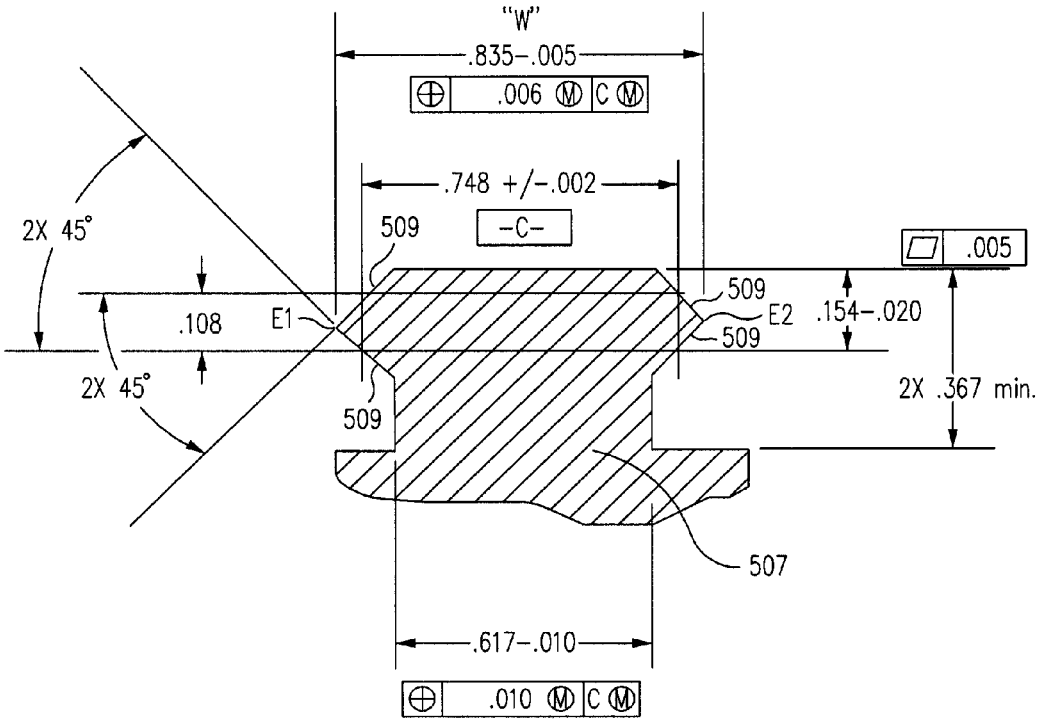
FIG. 5 (PRIOR ART)
FIG. 5 shows a cross-section of an exemplary Picatinny rail weapon accessory mounting surface crossbar.

For instance, since the entire floating side rail clamp is movably retained with respect to the floating side rail clamp weapon accessory mount adaptor body, the floating side rail clamp weapon accessory mount adaptor disclosed herein can be opened much wider than prior art biasing plate systems to accommodate a very significant variance in width "W" of a the rail weapon accessory mounting surface crossbars (507 in FIG. 5 and 107 in FIG. 1) between edges E1 and E2. In one embodiment, the disclosed floating side rail clamp weapon accessory mount adaptor can accommodate a variance in width "W" of 0.02 inches, four times the variance allowed by the Picatinny rail standard. As a result the floating side rail clamp weapon accessory mount adaptor disclosed herein can be attached to a rail body weapon accessory mounting surface by bringing the floating side rail clamp weapon accessory mount adaptor disclosed herein straight down onto the rail body weapon accessory mounting surface, without the need for the awkward, and often dangerously difficult, "align, tilt, roll, and snap" method for attaching prior art weapon accessory mount adaptors. Consequently, a weapon accessory mounting system including the floating side rail clamp weapon accessory mount adaptor disclosed herein is easier, and safer, to deploy in the field.

In addition, since the floating side rail clamp weapon accessory mount adaptor disclosed herein can be attached to a rail body weapon accessory mounting surface by bringing the floating side rail clamp weapon accessory mount adaptor straight down onto the rail body weapon accessory mounting surface, none of the uneven stresses associated with the "align, tilt, roll, and snap" method for attaching prior art weapon accessory mount adaptors are created.

In addition, since the floating side rail clamp weapon accessory mount adaptor disclosed herein can be opened much wider than prior systems to accommodate even a very significant variance in width "W" of a the rail weapon accessory mounting surface crossbars, the floating side rail clamp weapon accessory mount adaptor disclosed herein can accommodate rail body weapon accessory mounting surfaces that have significant variance and/or combat/field damage, and have even been manufactured outside of specification. As noted above, in one embodiment, floating side rail clamp weapon accessory mount adaptor disclosed herein can accommodate a variance in width "W" of 0.02 inches, four times the variance allowed by the Picatinny rail standard.

In addition, since the entire floating side rail clamp is movably retained with respect to the floating side rail clamp weapon accessory mount adaptor body, using the floating side rail clamp weapon accessory mount adaptor disclosed herein, the uneven engagement stresses caused by the prior art systems are eliminated and therefore weapon accessory alignments and sight pictures are better preserved.

In addition, since the entire floating side rail clamp is movably retained with respect to the floating side rail clamp weapon accessory mount adaptor body, using the floating side rail clamp weapon accessory mount adaptor disclosed herein, there is less chance that the floating side rail clamp weapon accessory mount adaptor will work loose and degrade the capability, or cause the loss of, the weapon accessory.

In addition, as discussed above, in one embodiment, the one or more leaf springs of the leaf spring assembly of the floating side rail clamp weapon accessory mount adaptor disclosed herein are in operative contact with the second surface of the floating side rail clamp such that when the leaf spring is subjected to an engagement pressure, and is thereby engaged, a leaf spring engagement force is exerted on the second surface of the floating side rail clamp in a relatively even manner along the length of the second surface of the floating side rail clamp and any variance in width "W" of the Picatinny rail is automatically adjusted to without the need for special tools and/or adjustments in the field.

In addition, as discussed above, in one embodiment, the one or more leaf springs of the leaf spring assembly of the floating side rail clamp weapon accessory mount adaptor disclosed herein are in operative contact with the second surface of the floating side rail clamp such that when the leaf spring is subjected to an engagement pressure, and is thereby engaged, a leaf spring engagement force is exerted on the second surface of the floating side rail clamp directly and in a relatively even manner along the length of the second surface of the floating side rail clamp. In this way the floating side rail clamp weapon accessory mount adaptor disclosed herein provides the highly desirable even and steadily increasing engagement pressure that was nearly impossible to achieve with prior art weapon accessory mount adaptors and their associated single cam surface contact points.

In addition, to further enable an even and steadily increasing engagement pressure, in one embodiment, the leaf spring engagement means of the floating side rail clamp weapon accessory mount adaptor disclosed herein is a cam system including a quick release lever attached to a cam such that when the user engages the quick release lever with increasing pressure, the quick release lever causes the cam to rotate and gradually increase a variable cam radius extending from the rotational axis of the cam to the leaf spring engagement surface, thereby gradually, and evenly, increasing the engagement pressure applied to the one or more leaf springs via the leaf spring engagement surface. The leaf springs, in turn, provide a more evenly distributed and smoothly increasing engagement force than is possible using a single cam surface contact point.

In addition, in on embodiment, the variable cam radius is specially designed to increase gradually such that when the floating side rail clamp weapon accessory mount adaptor is in the "fully locked" position, the cam is in the "center position" such that a cam lever extends along cam lever axis more or less parallel to a length of the floating side-rail as opposed to the "over center" position typically used in the prior art. Consequently, the floating side rail clamp weapon accessory mount adaptor disclosed herein can be more easily and intuitively lock and opened by the user.

In addition, a returning force is provided by one or more return springs that are incorporated in one embodiment of the floating side rail clamp weapon accessory mount adaptor disclosed herein. This returning force serves to further ensure that the leaf spring engagement force is applied evenly, and in a gradual and smooth manner, along the length of the second surface of the floating side rail clamp so that the entire floating side rail clamp moves as a unit in a direction substantially perpendicular to the stationary side rail clamp engagement surface such that the floating side rail clamp engagement surface of the floating side rail clamp remains substantially parallel to the corresponding portion of a stationary side rail clamp engagement surface.

In addition, in one embodiment, the returning force provided by the one or more return springs serves to return the floating side rail clamp to the fully open position as a default whenever the leaf spring engagement force is released and hold the floating side rail clamp weapon accessory mount adaptor in the ready open position having a maximum perpendicular distance "P" between the floating side rail clamp engagement surface of the floating side rail clamp and the corresponding portion of the stationary side rail clamp engagement surface of the stationary side rail clamp to accommodate even the largest reasonable variance in the width "W" of the rail weapon accessory mounting surface crossbars.

In addition, in one embodiment, the floating side rail clamp weapon accessory mount adaptor disclosed herein includes two or more floating side rail clamp weapon accessory mount adaptor crossbars and/or posts. In one embodiment, each of the two or more floating side rail clamp weapon accessory mount adaptor crossbars and/or posts is designed to be positioned between two consecutive rail weapon accessory mounting surface crossbars in a respective recoil channel. The use of two or more floating side rail clamp weapon accessory mount adaptor crossbars and/or posts helps minimize, and/or eliminate, the piston action discussed above by providing two separate floating side rail clamp weapon accessory mount adaptor crossbar and/or post contacts with two separate recoil channels in the rail body weapon accessory mounting surface. In addition, the use of two or more floating side rail clamp weapon accessory mount adaptor crossbars and/or posts helps minimize, and/or eliminate, rotational movement.

In addition, as noted above, in one embodiment, the floating side rail clamp weapon accessory mount adaptor disclosed herein requires no adjustment, and/or adjustment tools, in the field.

Consequently, a weapon accessory mounting system employing the floating side rail clamp weapon accessory mount adaptor disclosed herein provides weapons users, including soldiers and law enforcement officers in the field, with a weapon accessory mounting system that is easy to use, even in the field and/or under fire, is highly reliable, and has significant tolerance for dimensional variation and combat damage. Therefore, the floating side rail clamp weapon accessory mount adaptor disclosed herein provides weapons accessory capability that is extremely versatile and combat effective.

The present invention has been described in particular detail with respect to specific possible embodiments. Those of skill in the art will appreciate that the invention may be practiced in other embodiments. For example, the nomenclature used for components, capitalization of component designations and terms, the attributes, is not significant, mandatory, or limiting. Also, particular divisions of functionality between the various components described herein are merely exemplary, and not mandatory or significant. Consequently, functions performed by a single component may, in other embodiments, be performed by multiple components, and functions performed by multiple components may, in other embodiments, be performed by a single component.

In addition, the particular weapon accessory mounting systems and rail body weapon accessory mounting surfaces discussed above, such as Picatinny rail and Weaver rail systems, were used for illustrative purposes only. In other embodiments, other weapon accessory mounting systems and rail body weapon accessory mounting surfaces can be used with the disclosed floating side rail clamp weapon accessory mount adaptor with little, or no, modification. Consequently, it is envisioned the disclosed floating side rail clamp weapon accessory mount adaptor can be used with any weapon accessory mounting systems and rail body weapon accessory mounting surfaces, as discussed herein, and/or known in the art at the time of filing, and/or as developed after the time of filing.

Those of skill in the art will readily recognize that the disclosure presented herein is not inherently related to any particular mounting system, accessory, industry standard, or any other specific apparatus. Various mounting systems, accessories, industry standards, or any other specific apparatuses may also be used with, or make use of, the disclosed device in accordance with the teaching herein.

It should also be noted that the language used in the specification has been principally selected for readability, clarity and instructional purposes, and may not have been selected to delineate or circumscribe the inventive subject matter. Accordingly, the disclosure of the present invention is intended to be illustrative, but not limiting, of the scope of the invention, which is set forth in the claims below.

Therefore, numerous variations, whether explicitly provided for by the specification or implied by the specification or not, may be implemented by one of skill in the art in view of this disclosure.

What is claimed is:

1. A floating side rail clamp weapon accessory mount adaptor for mounting a weapon accessory to a rail body weapon accessory mounting surface, the floating side rail clamp weapon accessory mount adaptor comprising:

a floating side rail clamp weapon accessory mount adaptor body, the floating side rail clamp weapon accessory mount adaptor body including a first floating side rail clamp weapon accessory mount adaptor body side and a second floating side rail clamp weapon accessory mount adaptor body side, the first floating side rail clamp weapon accessory mount adaptor body side being opposite the second floating side rail clamp weapon accessory mount adaptor body side, the floating side rail clamp weapon accessory mount adaptor body including at least two floating side rail clamp weapon accessory mount adaptor post attachment positions;

a stationary side rail clamp, the stationary side rail clamp being positioned on the first floating side rail clamp weapon accessory mount adaptor body side, the stationary side rail clamp including a stationary side rail clamp engagement surface for removably engaging a rail body weapon accessory mounting surface first edge of the rail body weapon accessory mounting surface, the stationary side rail clamp engagement surface extending a stationary side rail clamp engagement surface length;

a floating side rail clamp, the floating side rail clamp being movably positioned with respect to the second floating side rail clamp weapon accessory mount adaptor body side, the floating side rail clamp having a floating side rail clamp first surface and a floating side rail clamp second surface, the floating side rail clamp first surface being opposite the floating side rail clamp second surface, the floating side rail clamp including at least two floating side rail clamp weapon accessory mount adaptor post holes formed through the floating side rail clamp from the floating side rail clamp first surface to the floating side rail clamp second surface, the floating side rail clamp first surface including a floating side rail clamp engagement surface for removably engaging a rail body weapon accessory mounting surface second edge of the rail body weapon accessory mounting surface, the floating side rail clamp engagement surface extending a floating side rail clamp engagement surface length in a direction parallel to the stationary side rail clamp engagement surface length such that the floating side rail clamp engagement surface of the floating side rail faces at least a portion of the stationary side rail clamp engagement surface of the stationary side rail clamp and at least a portion of the floating side rail clamp engagement surface length of the floating side rail is substantially parallel to the at least a portion of the stationary side rail clamp engagement surface length of the stationary side rail clamp, the floating side rail clamp being movably positioned with respect to the second floating side rail clamp weapon accessory mount adaptor body side such that the floating side rail clamp can move, as a unit, along an axis perpendicular to the floating side rail clamp engagement surface length of the floating side rail and perpendicular to the at least a portion of the stationary side rail clamp engagement surface length of the stationary side rail clamp;

at least two floating side rail clamp weapon accessory mount adaptor posts, each of the at least two floating side rail clamp weapon accessory mount adaptor posts including a floating side rail clamp weapon accessory mount adaptor post first end and a floating side rail clamp weapon accessory mount adaptor post second end, the floating side rail clamp weapon accessory mount adaptor post first end being opposite the floating side rail clamp weapon accessory mount adaptor post second end along a floating side rail clamp weapon accessory mount adaptor post length, the at least two floating side rail clamp weapon accessory mount adaptor posts being positioned such that the floating side rail clamp weapon accessory mount adaptor post first ends extend through the floating side rail clamp weapon accessory mount adaptor post holes formed through the floating side rail clamp to the second surface of the floating side rail clamp, the at least two floating side rail clamp weapon accessory mount adaptor posts being positioned such that the floating side rail clamp weapon accessory mount adaptor post second ends extend through the floating side rail clamp weapon accessory mount adaptor post holes formed through the floating side rail clamp to the at least two floating side rail clamp weapon accessory mount adaptor post attachment positions, a spring system, the spring system being in operative contact with the floating side rail clamp second surface and positioned on the second floating side rail clamp weapon accessory mount adaptor body side;

a cam system including a cam quick release lever and an attached cam, the cam having a cam spring engagement surface, the cam system applying an engagement pressure on the spring system when the cam system is activated; wherein in response to the activation of the cam system, the spring system imparts an engagement force onto the floating side rail clamp second surface causing the floating side rail clamp to move, as a unit, along the at least two floating side rail clamp weapon accessory mount adaptor posts and an axis perpendicular to the floating side rail clamp engagement surface length of the floating side rail and perpendicular to the at least a portion of the stationary side rail clamp engagement surface length of the stationary side rail clamp such that the floating side rail clamp engagement surface of the floating side rail clamp remains substantially parallel to a corresponding portion of the stationary side rail clamp engagement surface of the stationary side rail clamp as the floating side rail clamp moves, as a unit, along the at least two floating side rail clamp weapon accessory mount adaptor posts towards the stationary side rail clamp in a direction substantially perpendicular to the stationary side rail clamp engagement surface length.

2. The floating side rail clamp weapon accessory mount adaptor of claim 1, wherein:

the cam quick release lever causes the cam to rotate and gradually increase a variable cam radius extending from a rotational axis of the cam to the cam spring engagement surface, thereby gradually, and evenly, increasing engagement pressure on the spring system.

3. The floating side rail clamp weapon accessory mount adaptor of claim 1, wherein:

the rail body weapon accessory mounting surface is a Picatinny rail.

4. The floating side rail clamp weapon accessory mount adaptor of claim 1, wherein:

the rail body weapon accessory mounting surface is a Weaver rail.

5. The floating side rail clamp weapon accessory mount adaptor of claim 1, further comprising:

two or more floating side rail clamp weapon accessory mount adaptor crossbars, the two or more floating side rail clamp weapon accessory mount adaptor crossbars being positioned on the floating side rail clamp weapon accessory mount adaptor body, each of the two or more floating side rail clamp weapon accessory mount adaptor crossbars having a floating side rail clamp weapon accessory mount adaptor crossbar length extending between the first floating side rail clamp weapon accessory mount adaptor body side and the second floating side rail clamp weapon accessory mount adaptor body side and perpendicular to the stationary side rail clamp engagement surface length and the floating side rail clamp engagement surface length, each of the two or more floating side rail clamp weapon accessory mount adaptor crossbars designed to be positioned in a separate recoil channel of the rail body weapon accessory mounting surface.

6. A floating side rail clamp weapon accessory mount adaptor for mounting a weapon accessory to a rail body weapon accessory mounting surface, the floating side rail clamp weapon accessory mount adaptor comprising:

a floating side rail clamp weapon accessory mount adaptor body, the floating side rail clamp weapon accessory mount adaptor body including a first floating side rail clamp weapon accessory mount adaptor body side and a second floating side rail clamp weapon accessory mount adaptor body side, the first floating side rail clamp weapon accessory mount adaptor body side being opposite the second floating side rail clamp weapon accessory mount adaptor body side, the floating side rail clamp weapon accessory mount adaptor body including at least two floating side rail clamp weapon accessory mount adaptor post attachment positions;

a stationary side rail clamp, the stationary side rail clamp being positioned on the first floating side rail clamp weapon accessory mount adaptor body side, the stationary side rail clamp including a stationary side rail clamp engagement surface for removably engaging a rail body weapon accessory mounting surface first edge of the rail body weapon accessory mounting surface, the stationary side rail clamp engagement surface extending a stationary side rail clamp engagement surface length;

a floating side rail clamp, the floating side rail clamp being movably positioned with respect to the second floating side rail clamp weapon accessory mount adaptor body side, the floating side rail clamp having a floating side rail clamp first surface and a floating side rail clamp second surface, the floating side rail clamp first surface being opposite the floating side rail clamp second surface, the floating side rail clamp including at least two floating side rail clamp weapon accessory mount adaptor post holes formed through the floating side rail clamp from the floating side rail clamp first surface to the floating side rail clamp second surface, the floating side rail clamp first surface including a floating side rail clamp engagement surface for removably engaging a rail body weapon accessory mounting surface second edge of the rail body weapon accessory mounting surface, the floating side rail clamp engagement surface extending a floating side rail clamp engagement surface length in a direction parallel to the stationary side rail clamp engagement surface length such that the floating side rail clamp engagement surface of the floating side rail faces at least a portion of the stationary side rail clamp engagement surface of the stationary side rail clamp and at least a portion of the floating side rail clamp engagement surface length of the floating side rail is substantially parallel to the at least a portion of the stationary side rail clamp engagement surface length of the stationary side rail clamp, the floating side rail clamp being movably positioned with respect to the second floating side rail clamp weapon accessory mount adaptor body side such that the floating side rail clamp can move, as a unit, along an axis perpendicular to the floating side rail clamp engagement surface length of the floating side rail and perpendicular to the at least a portion of the stationary side rail clamp engagement surface length of the stationary side rail clamp;

at least two floating side rail clamp weapon accessory mount adaptor posts, each of the at least two floating side rail clamp weapon accessory mount adaptor posts including a floating side rail clamp weapon accessory mount adaptor post first end and a floating side rail clamp weapon accessory mount adaptor post second end, the floating side rail clamp weapon accessory mount adaptor post first end being opposite the floating side rail clamp weapon accessory mount adaptor post second end along a floating side rail clamp weapon accessory mount adaptor post length, the at least two floating side rail clamp weapon accessory mount adaptor posts being positioned such that the floating side rail clamp weapon accessory mount adaptor post first ends extend through the floating side rail clamp weapon accessory mount adaptor post holes formed through the floating side rail clamp to the second surface of the floating side rail clamp, the at least two floating side rail clamp weapon accessory mount adaptor posts being positioned such that the floating side rail clamp weapon accessory mount adaptor post second ends extend through the floating side rail clamp weapon accessory mount adaptor post holes formed through the floating side rail clamp to the at least two floating side rail clamp weapon accessory mount adaptor post attachment positions, a leaf spring system, the leaf spring system being in operative contact with the floating side rail clamp second surface and positioned on the second floating side rail clamp weapon accessory mount adaptor body side;

a cam system including a cam quick release lever and an attached cam, the cam having a cam leaf spring engagement surface, the cam system applying an engagement pressure on the leaf spring system when the cam system is activated; wherein in response to the activation of the cam system, the leaf spring system imparts an engagement force onto the floating side rail clamp second surface causing the floating side rail clamp to move, as a unit, along the at least two floating side rail clamp weapon accessory mount adaptor posts and an axis perpendicular to the floating side rail clamp engagement surface length of the floating side rail and perpendicular to the at least a portion of the stationary side rail clamp engagement surface length of the stationary side rail clamp such that the floating side rail clamp engagement surface of the floating side rail clamp remains substantially parallel to a corresponding portion of the stationary side rail clamp engagement surface of the stationary side rail clamp as the floating side rail clamp moves, as a unit, along the at least two floating side rail clamp weapon accessory mount adaptor posts towards the stationary side rail clamp in a direction substantially perpendicular to the stationary side rail clamp engagement surface length.

7. The floating side rail clamp weapon accessory mount adaptor of claim 6, wherein:

the rail body weapon accessory mounting surface is a Picatinny rail.

8. The floating side rail clamp weapon accessory mount adaptor of claim 6, wherein:

the rail body weapon accessory mounting surface is a Weaver rail.

9. The floating side rail clamp weapon accessory mount adaptor of claim 6, wherein:

the cam quick release lever causes the cam to rotate and gradually increase a variable cam radius extending from a rotational axis of the cam to the cam leaf spring engagement surface, thereby gradually, and evenly, increasing engagement pressure on the leaf spring system.

10. The floating side rail clamp weapon accessory mount adaptor of claim 6, further comprising:

two or more floating side rail clamp weapon accessory mount adaptor crossbars, the two or more floating side rail clamp weapon accessory mount adaptor crossbars being positioned on the floating side rail clamp weapon accessory mount adaptor body, each of the two or more floating side rail clamp weapon accessory mount adaptor crossbars having a floating side rail clamp weapon accessory mount adaptor crossbar length extending between the first floating side rail clamp weapon accessory mount adaptor body side and the second floating side rail clamp weapon accessory mount adaptor body side and perpendicular to the stationary side rail clamp engagement surface length and the floating side rail clamp engagement surface length, each of the two or more floating side rail clamp weapon accessory mount adaptor crossbars designed to be positioned in a separate recoil channel of the rail body weapon accessory mounting surface.

11. A weapon accessory mounting system, the weapon accessory mounting system comprising:

a rail body weapon accessory mounting surface; and a floating side rail clamp weapon accessory mount adaptor for mounting a weapon accessory to the rail body weapon accessory mounting surface, the floating side rail clamp weapon accessory mount adaptor including:

a floating side rail clamp weapon accessory mount adaptor body, the floating side rail clamp weapon accessory mount adaptor body including a first floating side rail clamp weapon accessory mount adaptor body side and a second floating side rail clamp weapon accessory mount adaptor body side, the first floating side rail clamp weapon accessory mount adaptor body side being opposite the second floating side rail clamp weapon accessory mount adaptor body side, the floating side rail clamp weapon accessory mount adaptor body including at least two floating side rail clamp weapon accessory mount adaptor post attachment positions;

a stationary side rail clamp, the stationary side rail clamp being positioned on the first floating side rail clamp weapon accessory mount adaptor body side, the stationary side rail clamp including a stationary side rail clamp engagement surface for removably engaging a rail body weapon accessory mounting surface first edge of the rail body weapon accessory mounting surface, the stationary side rail clamp engagement surface extending a stationary side rail clamp engagement surface length;

a floating side rail clamp, the floating side rail clamp being movably positioned with respect to the second floating side rail clamp weapon accessory mount adaptor body side, the floating side rail clamp having a floating side rail clamp first surface and a floating side rail clamp second surface, the floating side rail clamp first surface being opposite the floating side rail clamp second surface, the floating side rail clamp including at least two floating side rail clamp weapon accessory mount adaptor post holes formed through the floating side rail clamp from the floating side rail clamp first surface to the floating side rail clamp second surface, the floating side rail clamp first surface including a floating side rail clamp engagement surface for removably engaging a rail body weapon accessory mounting surface second edge of the rail body weapon accessory mounting surface, the floating side rail clamp engagement surface extending a floating side rail clamp engagement surface length in a direction parallel to the stationary side rail clamp engagement surface length such that the floating side rail clamp engagement surface of the floating side rail faces at least a portion of the stationary side rail clamp engagement surface of the stationary side rail clamp and at least a portion of the floating side rail clamp engagement surface length of the floating side rail is substantially parallel to the at least a portion of the stationary side rail clamp engagement surface length of the stationary side rail clamp, the floating side rail clamp being movably positioned with respect to the second floating side rail clamp weapon accessory mount adaptor body side such that the floating side rail clamp can move, as a unit, along an axis perpendicular to the floating side rail clamp engagement surface length of the floating side rail and perpendicular to the at least a portion of the stationary side rail clamp engagement surface length of the stationary side rail clamp;

at least two floating side rail clamp weapon accessory mount adaptor posts, each of the at least two floating side rail clamp weapon accessory mount adaptor posts including a floating side rail clamp weapon accessory mount adaptor post first end and a floating side rail clamp weapon accessory mount adaptor post second end, the floating side rail clamp weapon accessory mount adaptor post first end being opposite the floating side rail clamp weapon accessory mount adaptor post second end along a floating side rail clamp weapon accessory mount adaptor post length, the at least two floating side rail clamp weapon accessory mount adaptor posts being positioned such that the floating side rail clamp weapon accessory mount adaptor post first ends extend through the floating side rail clamp weapon accessory mount adaptor post holes formed through the floating side rail clamp to the second surface of the floating side rail clamp, the at least two floating side rail clamp weapon accessory mount adaptor posts being positioned such that the floating side rail clamp weapon accessory mount adaptor post second ends extend through the floating side rail clamp weapon accessory mount adaptor post holes formed through the floating side rail clamp to the at least two floating side rail clamp weapon accessory mount adaptor post attachment positions, a spring system, the spring system being in operative contact with the floating side rail clamp second surface and positioned on the second floating side rail clamp weapon accessory mount adaptor body side;

a cam system including a cam quick release lever and an attached cam, the cam having a cam spring engagement surface, the cam system applying an engagement pressure on the spring system when the cam system is activated; wherein in response to the activation of the cam system and the engagement pressure on the spring system, the spring system imparts an engagement force onto the floating side rail clamp second surface causing the floating side rail clamp to move, as a unit, along the at least two floating side rail clamp weapon accessory mount adaptor posts and an axis perpendicular to the floating side rail clamp engagement surface length of the floating side rail and perpendicular to the at least a portion of the stationary side rail clamp engagement surface length of the stationary side rail clamp such that the floating side rail clamp engagement surface of the floating side rail clamp remains substantially parallel to a corresponding portion of the stationary side rail clamp engagement surface of the stationary side rail clamp as the floating side rail clamp moves, as a unit, along the at least two floating side rail clamp weapon accessory mount adaptor posts towards the stationary side rail clamp in a direction substantially perpendicular to the stationary side rail clamp engagement surface length.

12. The weapon accessory mounting system of claim 11, wherein:

the cam quick release lever causes the cam to rotate and gradually increase a variable cam radius extending from a rotational axis of the cam to the cam spring engagement surface, thereby gradually, and evenly, increasing engagement pressure on the spring system.

13. The weapon accessory mounting system of claim 11, wherein:

the rail body weapon accessory mounting surface is a Picatinny rail.

14. The weapon accessory mounting system of claim 11, wherein:

the rail body weapon accessory mounting surface is a Weaver rail.

15. The weapon accessory mounting system of claim 11, wherein the floating side rail clamp weapon accessory mount adaptor further includes:

two or more floating side rail clamp weapon accessory mount adaptor crossbars, the two or more floating side rail clamp weapon accessory mount adaptor crossbars being positioned on the floating side rail clamp weapon accessory mount adaptor body, each of the two or more floating side rail clamp weapon accessory mount adaptor crossbars having a floating side rail clamp weapon accessory mount adaptor crossbar length extending between the first floating side rail clamp weapon accessory mount adaptor body side and the second floating side rail clamp weapon accessory mount adaptor body side and perpendicular to the stationary side rail clamp engagement surface length and the floating side rail clamp engagement surface length, each of the two or more floating side rail clamp weapon accessory mount adaptor crossbars designed to be positioned in a separate recoil channel of the rail body weapon accessory mounting surface.

* * * * *